US012297002B2

(12) United States Patent
Konstmann et al.

(10) Patent No.: US 12,297,002 B2
(45) Date of Patent: May 13, 2025

(54) STRETCH-HOOD MACHINE WITH FILM-EVALUATION FEATURE

(71) Applicant: Signode Industrial Group LLC, Tampa, FL (US)

(72) Inventors: Tonny Konstmann, Nordborg (DK); Kevin Cukierski, Elmhurst, IL (US)

(73) Assignee: SIGNODE INDUSTRIAL GROUP LLC, Tampa, FL (US)

( * ) Notice: Subject to any disclaimer, the term of this patent is extended or adjusted under 35 U.S.C. 154(b) by 0 days.

(21) Appl. No.: 18/569,766

(22) PCT Filed: May 12, 2022

(86) PCT No.: PCT/US2022/072279

§ 371 (c)(1),
(2) Date: Dec. 13, 2023

(87) PCT Pub. No.: WO2022/266567

PCT Pub. Date: Dec. 22, 2022

(65) Prior Publication Data

US 2024/0262548 A1 Aug. 8, 2024

Related U.S. Application Data

(60) Provisional application No. 63/211,110, filed on Jun. 16, 2021.

(51) Int. Cl.
*B65B 9/13* (2006.01)
*B65B 61/00* (2006.01)

(52) U.S. Cl.
CPC ..... *B65B 9/135* (2013.01); *B65B 61/00* (2013.01)

(58) Field of Classification Search
CPC ..... B65B 9/135; B65B 11/585; B65B 53/02; B65B 61/00
See application file for complete search history.

(56) References Cited

U.S. PATENT DOCUMENTS 3,965,652 A * 6/1976 Cimins ..... B65B 9/135 53/567
4,063,401 A * 12/1977 Higgins ..... B65B 9/135 53/567
6,032,439 A * 3/2000 Birkenfeld ..... B65B 9/135 53/567
7,040,076 B2 * 5/2006 Lachenmeier ..... B65B 9/135 53/567
8,453,420 B2 * 6/2013 Schmidt ..... B65B 11/045 53/556

(Continued)

OTHER PUBLICATIONS

"International Search Report and Written Opinion", from corresponding PCT/US2022/072279, Sep. 19, 2022.

*Primary Examiner* — Andrew M Tecco
*Assistant Examiner* — Nicholas E Igbokwe
(74) *Attorney, Agent, or Firm* — Neal, Gerber & Eisenberg LLP

(57) ABSTRACT

Various embodiments of the present disclosure provide a stretch-hood machine configured to determine one or more measured performance parameters of a roll of a particular type of film and to determine whether the measured performance parameters are consistent with one or more corresponding baseline performance parameters for that type of film.

17 Claims, 20 Drawing Sheets

(56) References Cited

U.S. PATENT DOCUMENTS

| | | | | |
|---|---|---|---|---|
| 2009/0211205 | A1* | 8/2009 | Lachenmaier | B65B 9/135 53/461 |
| 2011/0258973 | A1 | 10/2011 | Czok et al. | |
| 2018/0044043 | A1* | 2/2018 | Frenzel | B65B 41/12 |
| 2019/0152632 | A1* | 5/2019 | Lorenzen | B65B 9/135 |

* cited by examiner

STRETCH-HOOD MACHINE WITH FILM-EVALUATION FEATURE

PRIORITY

This application is a national phase application of PCT/US2022/072279, filed on May 12, 2022, which claims priority to and the benefit of U.S. Provisional Patent Application No. 63/211,110, filed Jun. 16, 2021, the entire contents of which is incorporated herein by reference.

FIELD

The present disclosure relates to stretch-hood machines for wrapping loads of goods with tubular stretch film, and more particularly to stretch-hood machines configured to determine one or more measured performance parameters of a roll of a particular type of film and to determine whether the measured performance parameters are consistent with one or more corresponding baseline performance parameters for that type of film.

BACKGROUND

Stretch-hood machines wrap loads of goods with tubular plastic stretch film. These stretch-hood machines include a frame that supports a film-supply assembly, a film-opening assembly, and a reefing-and-wrapping assembly. The reefing-and-wrapping assembly includes a wrapping carriage that supports four reefing devices. Each reefing device includes a support that supports a drive roller and a vertically extending reefing finger. A motor drives the drive roller, and the reefing finger supports a freely rotatable guide roller. The drive roller is movable toward and away from the guide roller.

To wrap a load of goods, the film-supply assembly draws the tubular film from a film roll, cuts the film to a desired length to form a segment of tubular film, and in certain instances heat seals the top of the segment of tubular film closed. The film-opening assembly opens the bottom portion of the segment of tubular film so its perimeter is generally rectangular. Each reefing device moves laterally inwardly relative to the segment of tubular film to respective insertion positions in which they form an insertion configuration. The wrapping carriage then ascends relative to the segment of tubular film until the reefing fingers of the reefing devices enter the open bottom portion of the segment of tubular film near its four corners. The reefing devices then move laterally outwardly to respective reefing positions in which they form a reefing configuration in preparation for reefing the segment of tubular film onto the reefing fingers. The drive rollers of the reefing devices move toward their respective guide rollers to engage the outer surface of the segment of tubular film and force the inner surface of the segment of tubular film against the guide rollers, thereby sandwiching the tubular film between the rollers. The motors drive their respective drive rollers in a reefing rotational direction to reef (or gather) the segment of tubular film onto the reefing fingers.

After reefing, the reefing devices each move laterally outwardly into respective wrapping positions in which they form a wrapping configuration. Because the film is elastic, it stretches during this movement. The wrapping configuration is (and therefore the wrapping positions are) determined based on the size and shape of the load so the perimeter of the segment of tubular film is sized to circumscribe the load once the reefing devices reach the wrapping configuration. After the reefing devices reach the wrapping configuration, the wrapping carriage descends relative to the load. During this descent the motors drive the drive rollers of the reefing devices in an unreefing rotational direction opposite the reefing rotational direction at an unreefing speed to unreef the remainder of the film from the reefing fingers. As this occurs, the film attempts to return to its unstretched size and shape and laterally retracts onto the load, which unitizes the load and/or secures the load to a pallet. This completes the wrapping process, and a conveyor conveys the load from the stretch-hood machine.

There are many types of tubular plastic stretch film that have different performance parameters. Stretch-hood-machine operators select a particular type of tubular film to use for a given application based on that type of film's baseline performance parameters to ensure that loads are adequately wrapped and supported during transit. For instance, the film used to wrap a load of bricks typically has different parameters than the film used to wrap a load of medical supplies. One issue operators face is that due to inconsistencies in the manufacturing process or the raw material used to make film, certain rolls of a particular type of film may have performance parameters that differ from the baseline performance parameters of that type of film. In some cases, these differences are minimal and don't affect the ability of the film of that particular roll to perform as desired and adequately support the load during transit. But in other instances, these differences are significant and negatively affect the film's quality to the extent that the film does not adequately support the load and/or fails or otherwise exhibits suboptimal performance during transit. Compounding the problem is that these differences are not perceptible by the naked eye. There is a need for operators to be able to ensure the performance parameters of a particular roll of film are consistent with the baseline performance parameters for that particular type of film and will therefore perform as expected after wrapping.

SUMMARY

Various embodiments of the present disclosure provide a stretch-hood machine configured to determine one or more measured performance parameters of a roll of a particular type of film and to determine whether the measured performance parameters are consistent with one or more corresponding baseline performance parameters for that type of film.

DETAILED DESCRIPTION

Figure 1:
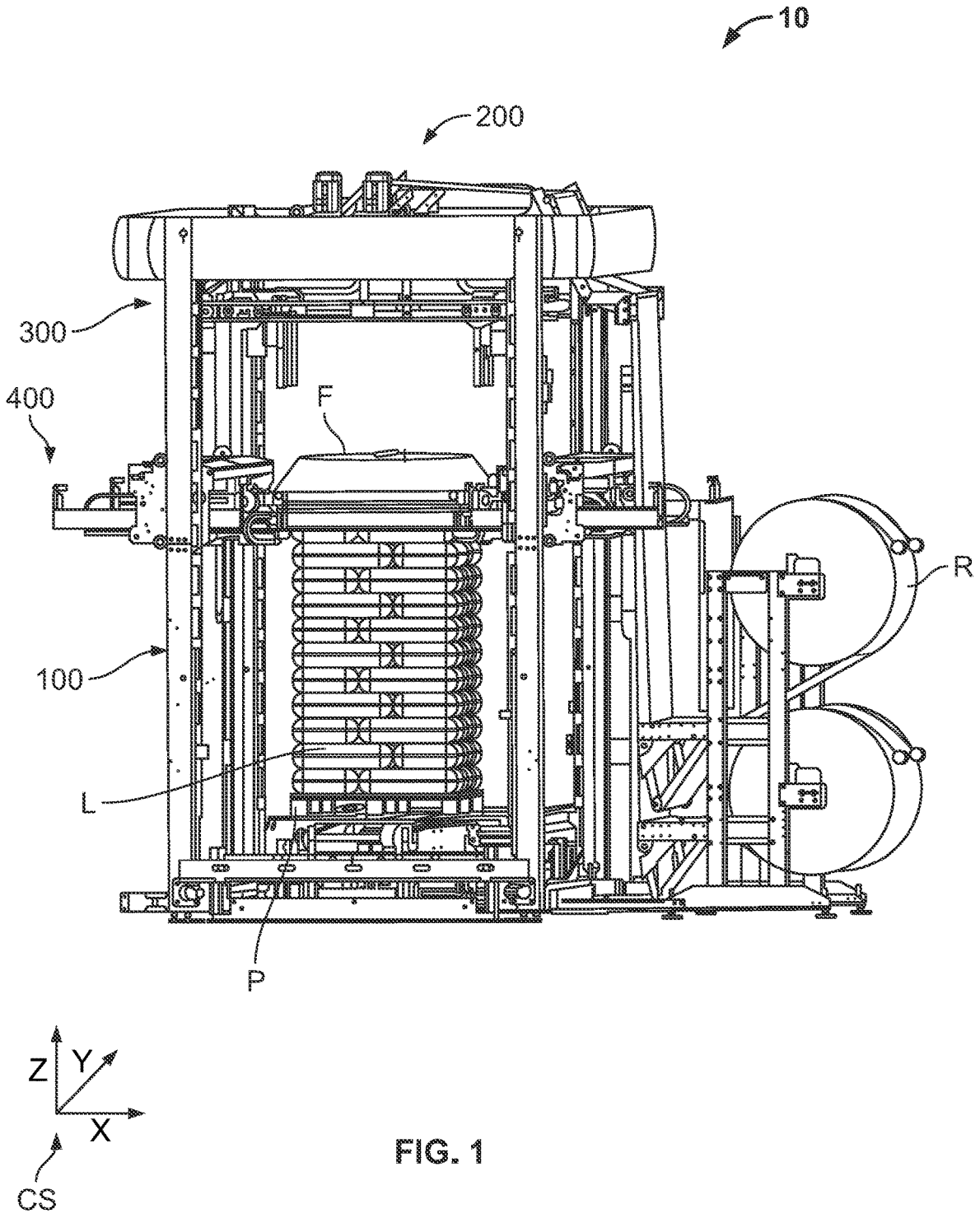
FIG. 1 is a perspective view of one embodiment of the stretch-hood machine of the present disclosure.
Figure 2:
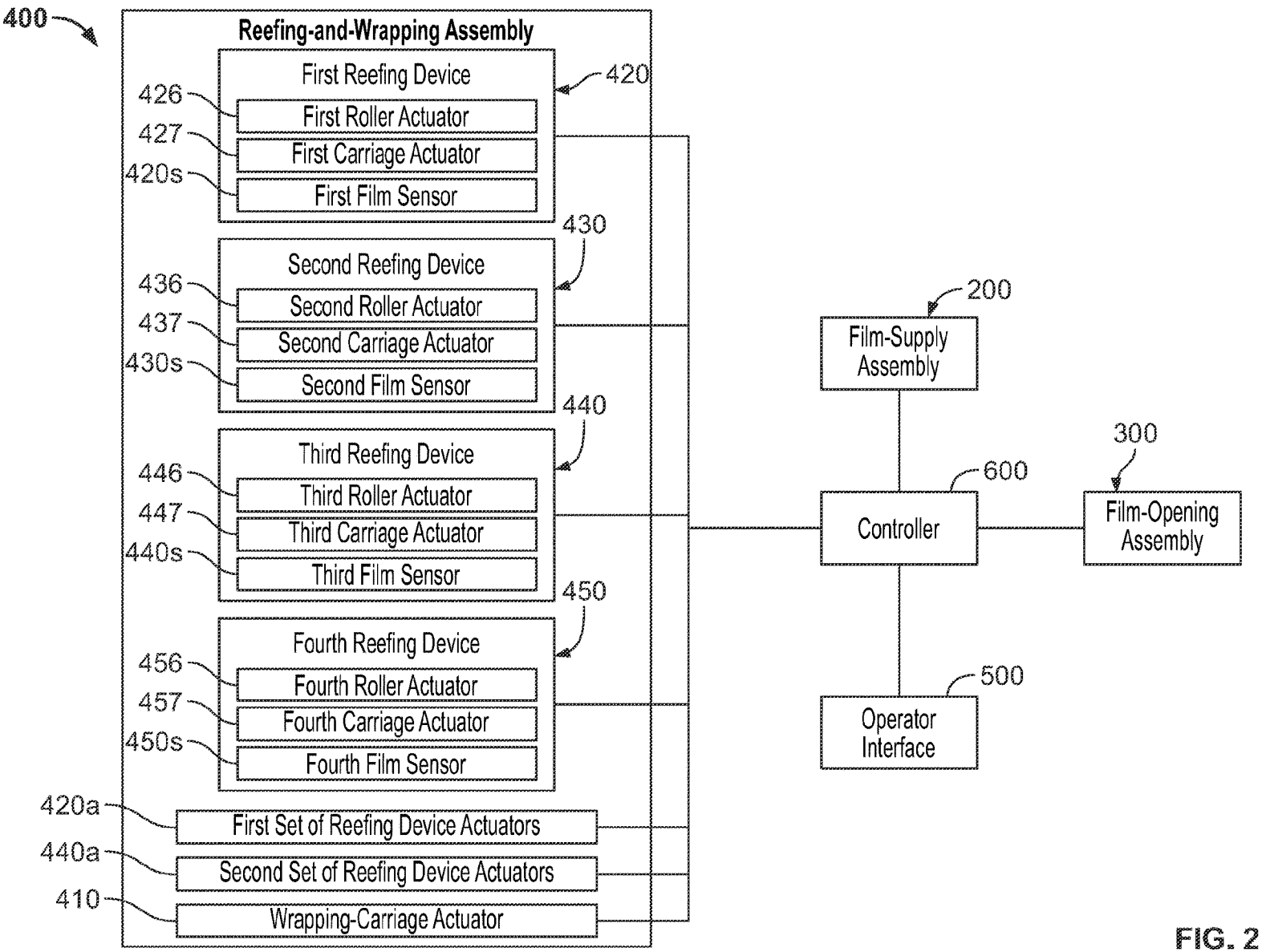
FIG. 2 is a block diagram showing certain components of the stretch-hood machine of FIG. 1.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Various embodiments of the present disclosure provide a stretch-hood machine configured to determine one or more measured performance parameters of a roll of a particular type of film and to determine whether the measured performance parameters are consistent with one or more corresponding baseline performance parameters for that type of film. In certain embodiments, the baseline performance parameters represent desired minimum performance parameters for that particular type of film. FIGS. 1-10 and 12A-12G show one embodiment of the stretch-hood machine 10 of the present disclosure and the assemblies and components of the stretch-hood machine 10. The stretch-hood machine 10 includes a machine frame 100, a film-supply assembly 200 supported by the machine frame 100, a film-opening assembly 300 supported by the machine frame 100, a reefing-and-wrapping assembly 400 supported by the machine frame 100, an operator interface 500, and a controller 600. A coordinate system CS (shown in FIG. 1) is used herein as a frame of reference for directional movement of various components of the stretch-hood machine 10 in the X-, Y-, and Z-directions (which are perpendicular to one another in this example embodiment).

The machine frame 100 is formed from multiple tubular and/or solid members and other elements (not individually labeled) and is configured to support the other assemblies and components of the stretch-hood machine 10. The machine frame 100 defines a wrapping area within its interior and has an infeed area (not labeled) at which a palletized load (such as a load L on a pallet P) is conveyed into the wrapping area for wrapping and an outfeed area (not labeled) at which the palletized load is conveyed from the wrapping area after wrapping. The illustrated machine frame 100 is merely one example configuration, and any suitable configuration may be employed.

The film-supply assembly 200 includes suitable components configured to form a segment of tubular film F that the stretch-hood machine 10 then uses to wrap the load L or evaluate the film. More specifically, and as is known in the art, the film-supply assembly 200 includes components suitable to draw a length of tubular film from a roll R of tubular film rotatably mounted to the machine frame 100, cut the length of tubular film from the roll R to form the segment of tubular film F, and (in certain instances) close the upper end of the segment of tubular film (such as via a heat-sealing mechanism). When wrapping a load L, the controller 600 determines the length of the segment of tubular film F based (in part) on the height of the load L, as is known in the art.

The film-opening assembly 300 includes suitable components configured to open a bottom portion of the segment of tubular film F so it forms a generally rectangular perimeter in preparation for reefing by the reefing-and-wrapping assembly 400. More specifically, and as is known in the art, the film-opening assembly 300 includes four suction boxes and four corresponding holding devices (not labeled) that are movable laterally inward and outward in the X- and Y-directions and generally parallel to the X-Y plane relative to the segment of tubular film F. To open the bottom portion of the segment of tubular film F, the suction boxes move laterally inward in the X- and Y-directions so they are positioned adjacent the outer surface of the bottom portion of the segment of tubular film F. A vacuum is generated to draw the bottom portion of the segment of tubular film F onto the suction boxes, thereby partially opening the bottom portion. The holding devices then clamp the segment of tubular film, and the suction boxes and holding devices move laterally outward in the X- and Y-directions and generally parallel to the X-Y plane to open the bottom portion of the segment of tubular film F in preparation for reefing. At this point, the perimeter of the bottom portion of the segment of tubular film F forms a generally rectangular shape in preparation for reefing. This is merely one example of the film-opening assembly 300, and other embodiments of the film-opening assembly 300 may include any other suitable components.

The reefing-and-wrapping assembly 400 includes a wrapping carriage (not shown for clarity); a wrapping-carriage actuator 410; first, second, third, and fourth reefing devices 420, 430, 440, and 450; and first and second sets of reefing-device actuators 420*a* and 440*a*. The wrapping carriage includes a suitable frame and is vertically movable relative to the machine frame 100 in the Z-direction between upper and lower positions. The wrapping-carriage actuator 410, which may include any suitable actuator (such as an electric or a hydraulic motor), is operably connected to the wrapping carriage to move the wrapping carriage between its upper and lower positions.

Figure 3:
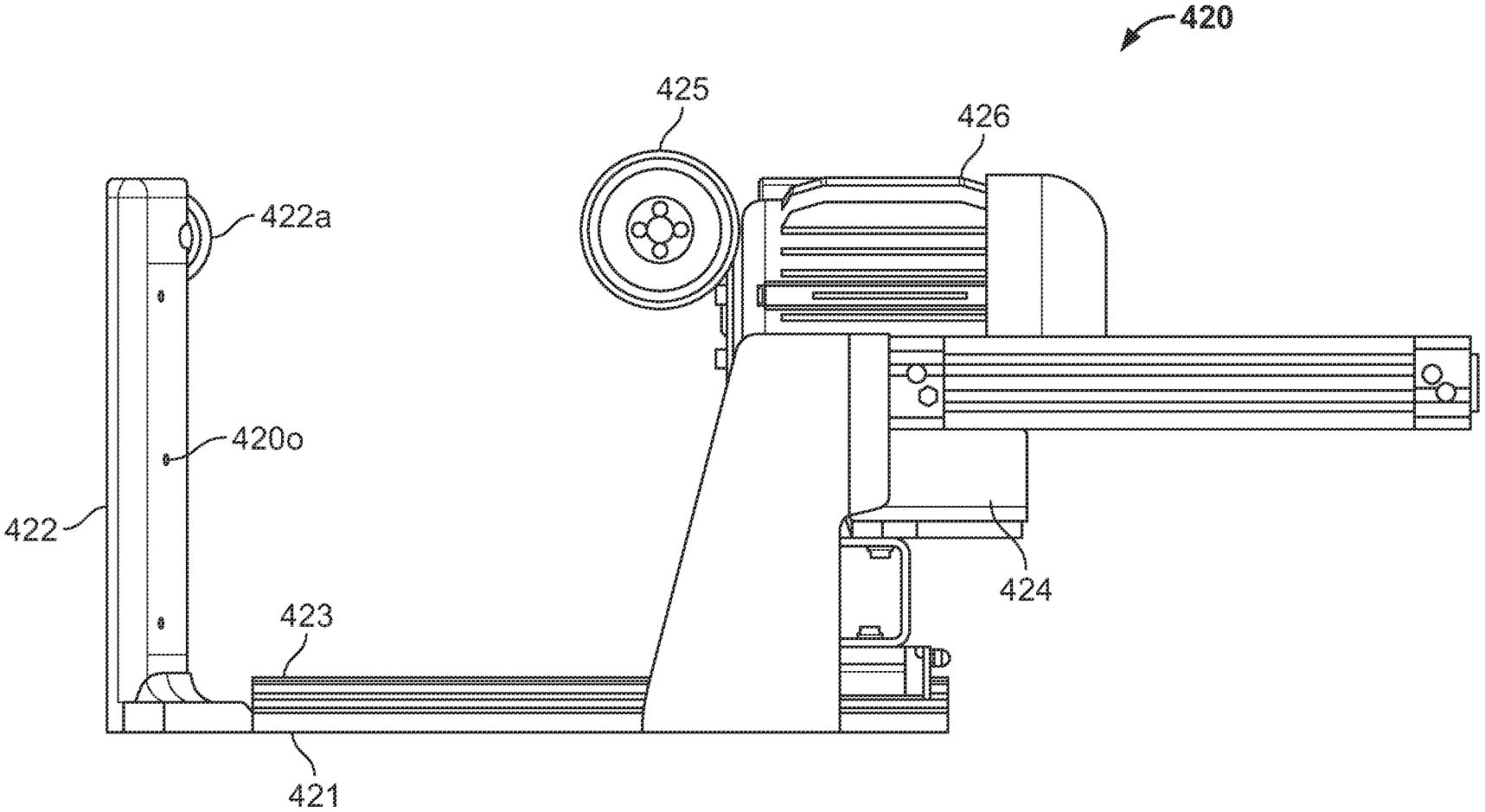
FIG. 3 is a side elevational view of one of the reefing devices of the stretch-hood machine of FIG. 1 with the reefing carriage in its home position.
Figure 8:
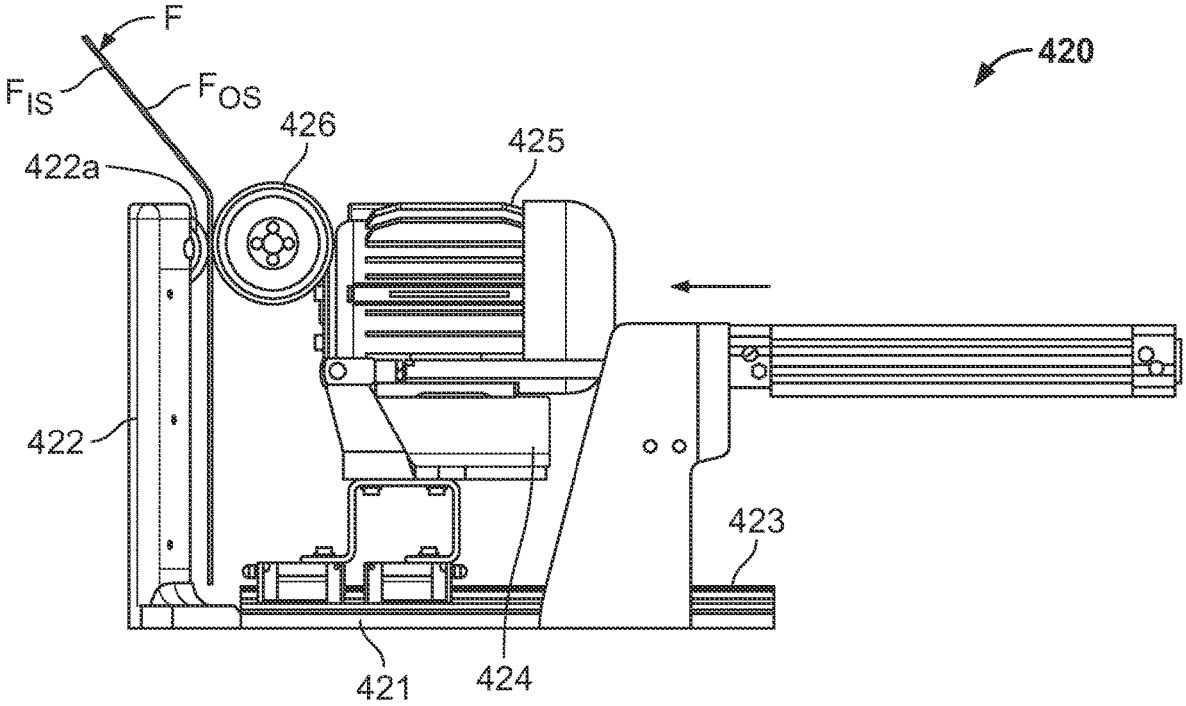
FIG. 8 is a side elevational view of the reefing device of FIG. 3 that corresponds to FIG. 6.
Figure 10:
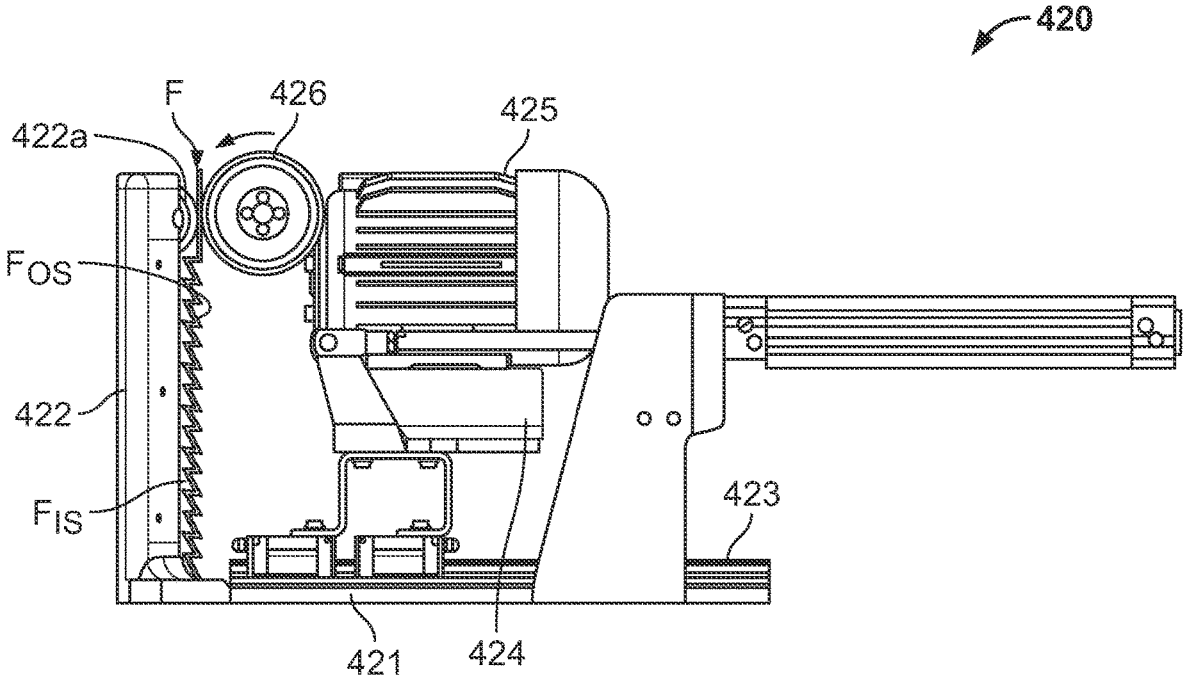
FIG. 10 is a side elevational view of the reefing device of FIG. 3 that corresponds to FIG. 9.

FIGS. 3, 8, and 10 show the first reefing device 420, which includes a first support 421, a first reefing finger 422 extending generally vertically in the Z-direction from one end of the first support 421, a freely rotatable first guide roller 422*a* mounted to the first reefing finger 422, a first rail 423 supported by the first support 421, a first carriage 424 mounted to the first rail 423 and configured to move along the first rail 423 between a home position spaced-apart from the first guide roller 422*a* (FIG. 3) and a reefing position adjacent the first guide roller 422*a* (FIGS. 8 and 10), a first drive roller 425 supported by the first carriage 424, a first roller actuator 426 supported by the first carriage 424 and operably connected to the first drive roller 425 to rotate the first drive roller 425 in opposing reefing and unreefing rotational directions, and a first carriage actuator 427 operably connected to the carriage 424 to move the carriage 424 between its home and reefing positions, and a first film sensor 420*s* configured to detect whether film is present on the reefing finger 422.

The second reefing device 430 is similar to the first reefing device 420 and not shown separately. The second reefing device includes a second support 431, a second reefing finger 432 extending generally vertically from one end of the second support 431, a freely rotatable second guide roller 432*a* mounted to the second reefing finger 432, a second rail 433 supported by the second support 431, a second carriage 434 mounted to the second rail 433 and configured to move along the second rail 433 between a home position spaced-apart from the second guide roller 432*a* and a reefing position adjacent the second guide roller 432*a*, a second drive roller 435 supported by the second carriage 434, a second roller actuator 436 supported by the second carriage 434 and operably connected to the second drive roller 435 to rotate the second drive roller 435 in opposing reefing and unreefing rotational directions, a second carriage actuator 437 operably connected to the carriage 434 to move the carriage 434 between its home and reefing positions, and a second film sensor 430*s* configured to detect whether film is present on the reefing finger 432.

The third reefing device 440 is similar to the first reefing device 420 and not shown separately. The third reefing device includes a third support 441, a third reefing finger 442 extending generally vertically from one end of the third support 441, a freely rotatable third guide roller 442*a* mounted to the third reefing finger 442, a third rail 443 supported by the third support 441, a third carriage 444 mounted to the third rail 443 and configured to move along the third rail 443 between a home position spaced-apart from the third guide roller 442*a* and a reefing position adjacent the third guide roller 442*a*, a third drive roller 445 supported by the third carriage 444, a third roller actuator 446 supported by the third carriage 444 and operably connected to the third drive roller 445 to rotate the third drive roller 445 in opposing reefing and unreefing rotational directions, a third carriage actuator 447 operably connected to the carriage 444 to move the carriage 444 between its home and reefing positions, and a third film sensor 440*s* configured to detect whether film is present on the reefing finger 442.

The fourth reefing device 450 is similar to the first reefing device 420 and not shown separately. The fourth reefing device includes a fourth support 451, a fourth reefing finger 452 extending generally vertically from one end of the fourth support 451, a freely rotatable fourth guide roller 452*a* mounted to the fourth reefing finger 452, a fourth rail 453 supported by the fourth support 451, a fourth carriage 454 mounted to the fourth rail 453 and configured to move along the fourth rail 453 between a home position spaced-apart from the fourth guide roller 452*a* and a reefing position adjacent the fourth guide roller 452*a*, a fourth drive roller 455 supported by the fourth carriage 454, a fourth roller actuator 456 supported by the fourth carriage 454 and operably connected to the fourth drive roller 455 to rotate the fourth drive roller 455 in opposing reefing and unreefing rotational directions, a fourth carriage actuator 457 operably connected to the carriage 454 to move the carriage 454 between its home and reefing positions, and a fourth film sensor 450*s* configured to detect whether film is present on the reefing finger 452.

The first, second, third, and fourth reefing devices 420, 430, 440, and 450 are mounted to the frame of the wrapping carriage in a generally rectangular arrangement. The first set of reefing-device actuators 420*a* is operably connected to the first and second reefing devices 420 and 430 to move the first and second reefing devices 420 and 430 laterally inwardly and outwardly in the X- and Y-directions and generally parallel to the X-Y plane relative to the wrapping carriage (and the load L and the segment of tubular film F). The second set of reefing-device actuators 440*a* is operably connected to the third and fourth reefing devices 440 and 450 to move the third and fourth reefing devices 440 and 450 laterally inwardly and outwardly in the X- and Y-directions and generally parallel to the X-Y plane relative to the wrapping carriage (and the load L and the segment of tubular film F).

The first set of reefing-device actuators 420*a* includes a first X-actuator and a first Y-actuator that are controlled independently of one another. The first X-actuator is operably connected to the first and second reefing devices 420 and 430 and configured to move the first and second reefing devices 420 and 430 relative to the wrapping carriage in the X-direction. The first Y-actuator is operably connected to the first and second reefing devices 420 and 430 and configured to move the first and second reefing devices 420 and 430 relative to the wrapping carriage in the Y-direction. In this example embodiment, the first X- and Y-actuators include electric motors controlled by separate variable-frequency drives, but the actuators may be any suitable actuators in other embodiments (such as hydraulic motors controlled by proportional solenoid valves). In this example embodiment, the first X-actuator moves the first and second reefing devices simultaneously and at the same rate towards and away from the load in the X-direction. Similarly, the first Y-actuator moves the first and second reefing devices simultaneously and at the same rate towards and away from the load in the Y-direction.

The second set of reefing-device actuators 440*a* includes a second X-actuator and a second Y-actuator that are controlled independently of one another. The second X-actuator is operably connected to the third and fourth reefing devices 440 and 450 and configured to move the third and fourth reefing devices 440 and 450 relative to the wrapping carriage in the X-direction. The second Y-actuator is operably connected to the third and fourth reefing devices 440 and 450 and configured to move the third and fourth reefing devices 440 and 450 relative to the wrapping carriage in the Y-direction. In this example embodiment, the second X- and Y-actuators include electric motors controlled by separate variable-frequency drives, but the actuators may be any suitable actuators in other embodiments (such as hydraulic motors controlled by proportional solenoid valves). In this example embodiment, the second X-actuator moves the third and fourth reefing devices simultaneously and at the same rate towards and away from the load in the X-direction. Similarly, the second Y-actuator moves the third and fourth reefing devices simultaneously and at the same rate towards and away from the load in the Y-direction.

In other embodiments, the stretch-hood machine includes a separate set of one or more reefing device actuators for each individual reefing device. In some of these embodiments, each set of reefing device actuators includes independently controlled X- and Y-actuators similar to those described above.

In this example embodiment, the walls of the first, second, third, and fourth reefing fingers 422, 432, 442, and 452 that the segment of tubular film F engages after reefing define respective openings 420*o*, 430*o*, 440*o*, and 450*o* therethrough that are in fluid communication with respective channels (not shown) defined in the reefing fingers. In this example embodiment, the first, second, third, and fourth film sensors 420*s*, 430*s*, 440*s*, and 450*s* (FIG. 2) include respective pressure sensors positioned within the channels of the respective reefing fingers. In operation, air from a compressed air source (such as a compressed air source pressurized at 0.2 bar) is introduced into the channels. For a given reefing finger, when film is not present on that reefing finger, the compressed air exits the channel through the opening. On the other hand, when film is present on the reefing finger, the film covers the opening and prevents the compressed air from exiting the channel. This causes the air pressure within the channel to increase, and the pressure sensor detects this increase in air pressure (and therefore the presence of the film on the reefing finger) and sends a corresponding signal to the controller 600. This is merely one example of the film sensors, and the film sensors may be any other suitable sensors in other embodiments, such as mechanical pressure sensors, optical proximity sensors, or ultrasonic proximity sensors.

The operator interface 500 is configured to receive inputs from an operator and, in certain embodiments, to output information to the operator. The operator interface includes one or more input devices configured to receive inputs from the operator. In various embodiments, the one or more input devices include one or more buttons (such as hard or soft keys), one or more switches, and/or a touch panel. In various embodiments, the operator interface 500 includes a display device configured to display information to the operator, such as information about the palletized load, the status of the wrapping operation, or the settings of the stretch-hood machine 10. The operator interface may include other output devices instead of or in addition to the display device, such as one or more speakers and/or one or more lights. In certain embodiments, the operator interface 500 is formed as part of the stretch-hood machine 10 and is, for instance, mounted to the machine frame 100. In other embodiments, the operator interface is remote from the stretch-hood machine 10.

The controller 600 includes a processing device communicatively connected to a memory device. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the stretch-hood machine 10 (such as to carry out the film-evaluation processes 1000 and 2000 described below).

The controller 600 is communicatively and operably connected to the film-supply assembly 200; the film-opening assembly 300; the wrapping-carriage actuator 410; the first and second sets of reefing-device actuators 420*a* and 440*a*; the first, second, third, and fourth sets of roller actuators 426, 436, 446, and 456; the first, second, third, and fourth carriage actuators 427, 437, 447, and 457; and the first, second, third, and fourth film sensors 420*s*, 430*s*, 440*s*, and 450*s* to control operation of and receive signals from these components to carry out the film-evaluation processes 1000 and 2000 described below. The controller 600 is communicatively connected to the operator interface 500 to: (1) receive signals from the operator interface 500 that represent inputs received by the operator interface 500; and (2) send signals to the operator interface 500 to cause the operator interface 500 to output (such as to display) information.

Figure 11A:
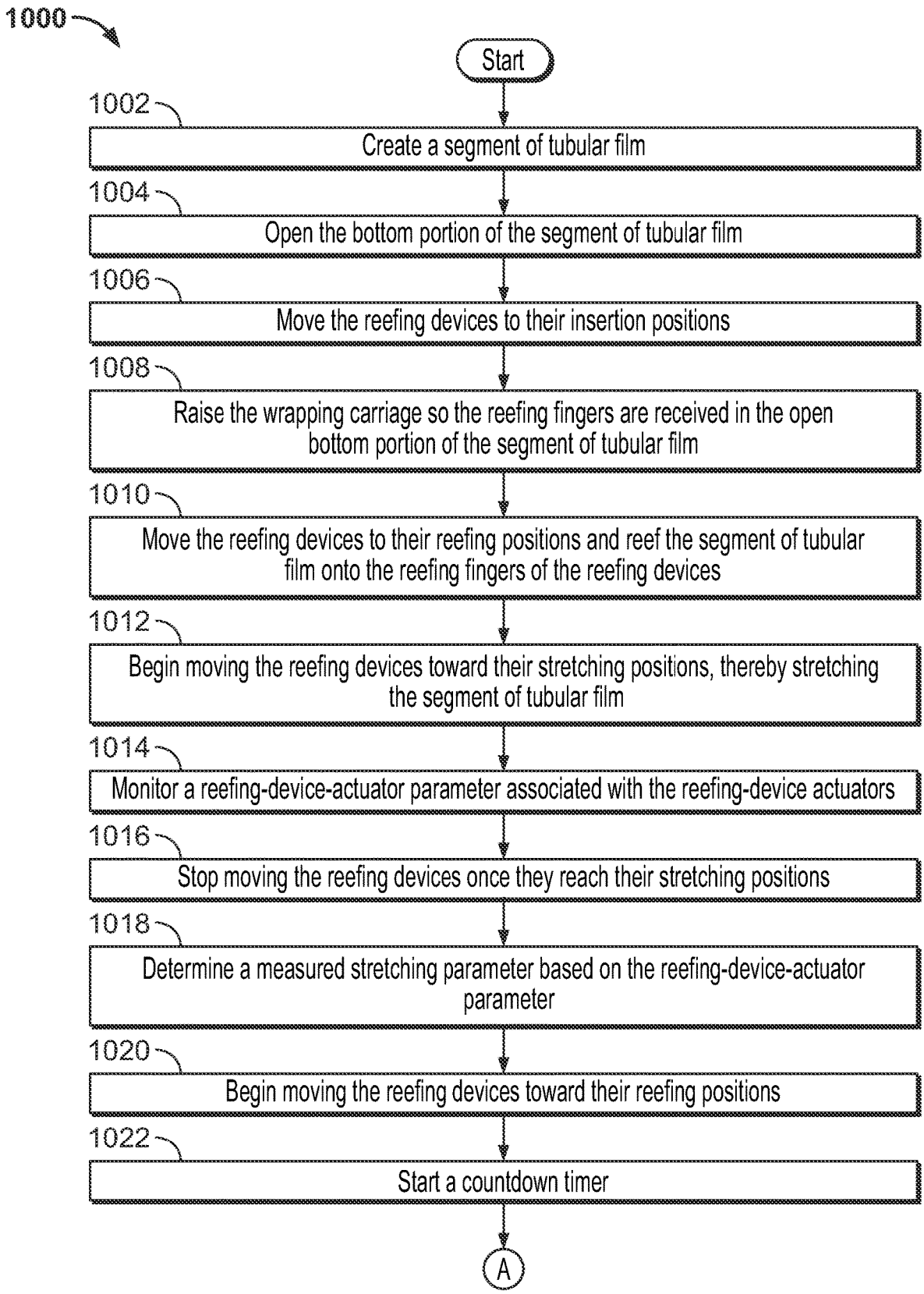
FIGS. 11A and 11B are a flowchart of an example film-evaluation process of the present disclosure.
Figure 11B:
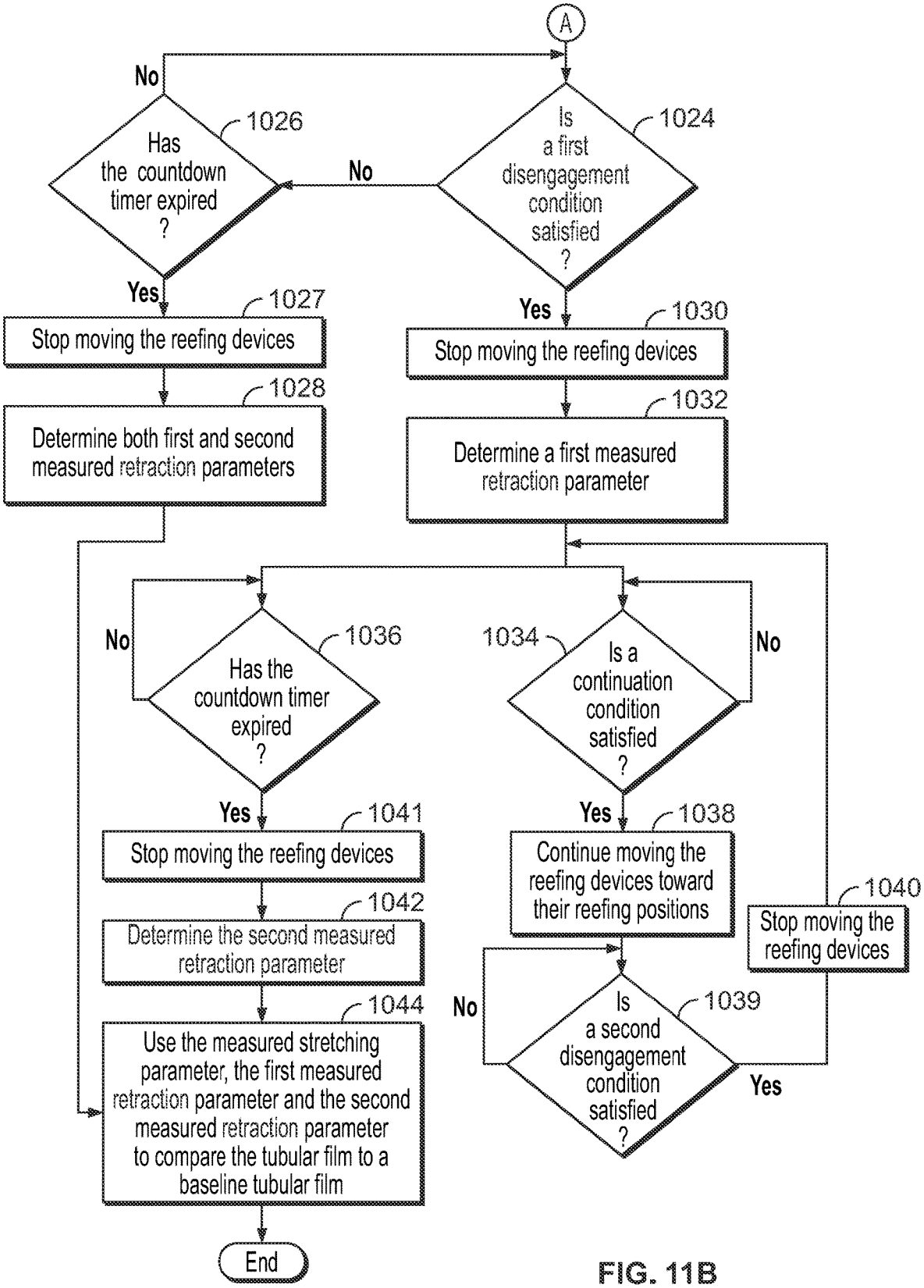

FIGS. 11A and 11B are a flowchart of an example film-evaluation process 1000 of the present disclosure, which will be described below with reference to FIGS. 3-10. Generally, by carrying out the film-evaluation process, the controller determines one or more performance parameters of the segment of tubular film F—and therefore the particular roll R of tubular film that segment was cut from—and compares them to one or more corresponding baseline performance parameters for that type of film to evaluate whether the roll of tubular film will perform as expected. The controller stores or is otherwise configured to access (such as via an Internet connection) the baseline performance parameters for comparison purposes. In certain embodiments, the controller is configured to determine the baseline performance parameters by carrying out a process similar to the film-evaluation process 1000, storing the measured parameters as baseline parameters, and not performing the comparing step. In various such embodiments, the baseline parameters are determined using the same machine used to determine the measured parameters (to avoid machine-to-machine variance).

More specifically, in this example embodiment, the controller 600 determines three performance parameters of the segment of tubular film F for comparison purposes: (1) a measured stretching parameter; (2) a first measured retraction parameter; and (3) a second measured retraction parameter. In this example embodiment, the measured stretching parameter is a measured stretching-force parameter represents the maximum force exerted on the segment of tubular film F by the reefing devices during stretching as the reefing devices move from their reefing positions to their stretching positions. In this example embodiment, as explained in detail below, the measured stretching parameter represents the maximum electric current drawn by the reefing-device actuators during stretching, which correlates to the maximum force the reefing devices impart on the film during stretching. The first measured retraction parameter is a measured snap-back parameter that represents how fast and how far the segment of tubular film retracts in a short period of time after stretching. In this example embodiment, as explained in detail below, the first measured retraction parameter represents the perimeter of the film at the first point in time the film disengages three of the reefing fingers as they move from their stretching positions back toward their reefing positions. The second measured retraction parameter is a measured memory parameter that represents how much the segment of tubular film retracts over a longer period of time. In this example embodiment, as explained in detail below, the second measured retraction parameter represents the perimeter of the film after the reefing devices have been moving from their stretching positions toward their reefing positions for a particular period of time.

Turning now to the film-evaluation process 1000, generally, a segment of tubular film is reefed on to the reefing fingers of the reefing devices. The reefing fingers are moved laterally outwardly from respective reefing positions to respective stretching positions, thereby causing the segment of tubular film to stretch. The reefing devices then move back laterally inwardly toward their respective reefing positions, thereby enabling the segment of tubular film to retract. The controller determines a measured performance parameter of the segment of tubular film based on feedback associated with the movement of the reefing devices. In this example embodiment, as described below, the feedback includes the electric current drawn by the reefing-device actuators during stretching and feedback from the film sensors of the reefing devices during retraction. The controller compares the measured performance parameter of the segment of tubular film with a baseline performance parameter and outputs an indication based on the comparison between the measured performance parameter and the baseline performance parameter.

More specifically, upon initiation of the film-evaluation process 100, a segment of tubular film is created, as block 1002 indicates. In this example embodiment, the controller 600 controls the film-supply assembly 200 to draw tubular film from the film roll R and cut the film to an evaluation length (which is 200 centimeters in this example embodiment but may be any other suitable length) to form the segment of tubular film F. The bottom portion of the segment of tubular film is then opened, as block 1004 indicates. In this example embodiment, the controller 600 controls the film-opening assembly 300 (and more particularly, the suction boxes and holding devices) to open the bottom portion of the segment of tubular film F so the shape of its perimeter is generally rectangular, as explained above.

Figure 4:
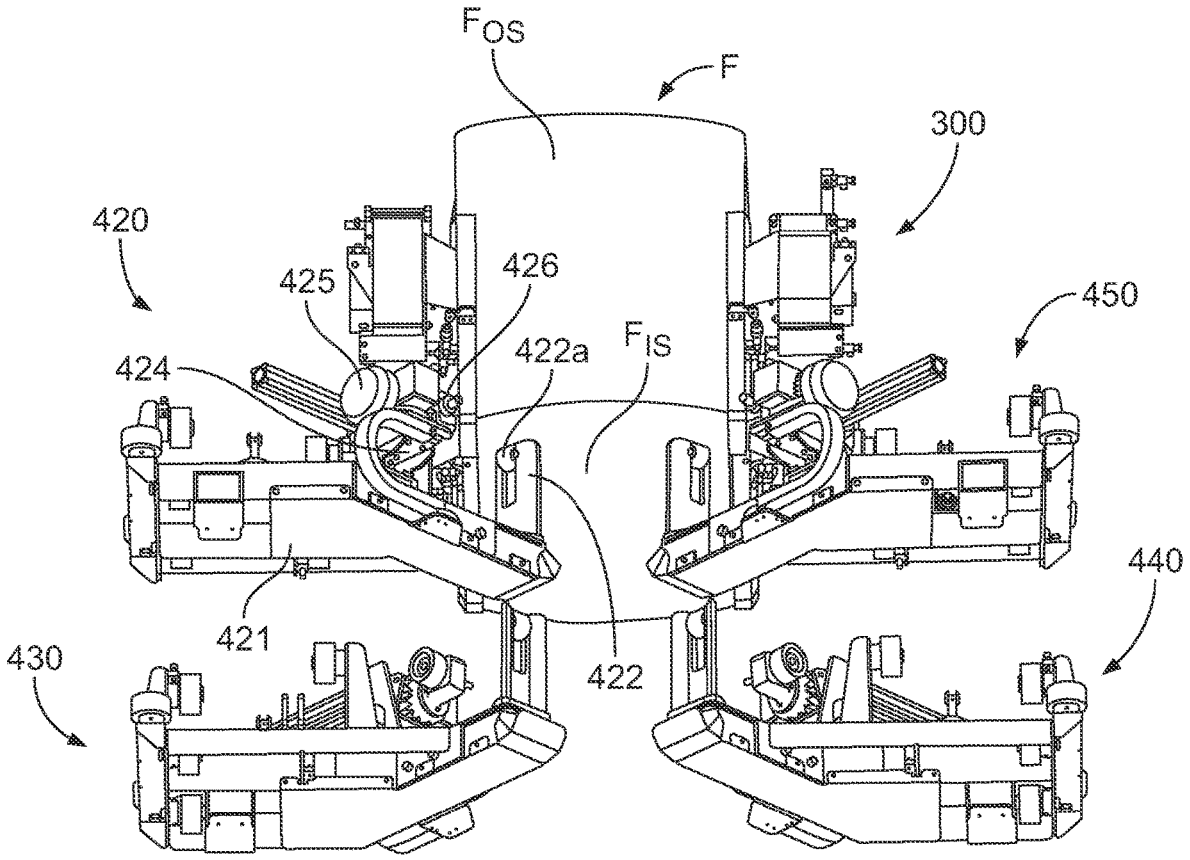
FIG. 4 is a perspective view of the film-opening device and the reefing devices of the stretch-hood machine of FIG. 1 after the film-opening device has opened the bottom of a segment of tubular film and before the reefing fingers of the reefing devices have been inserted into the bottom of the segment of tubular film.
Figure 5:
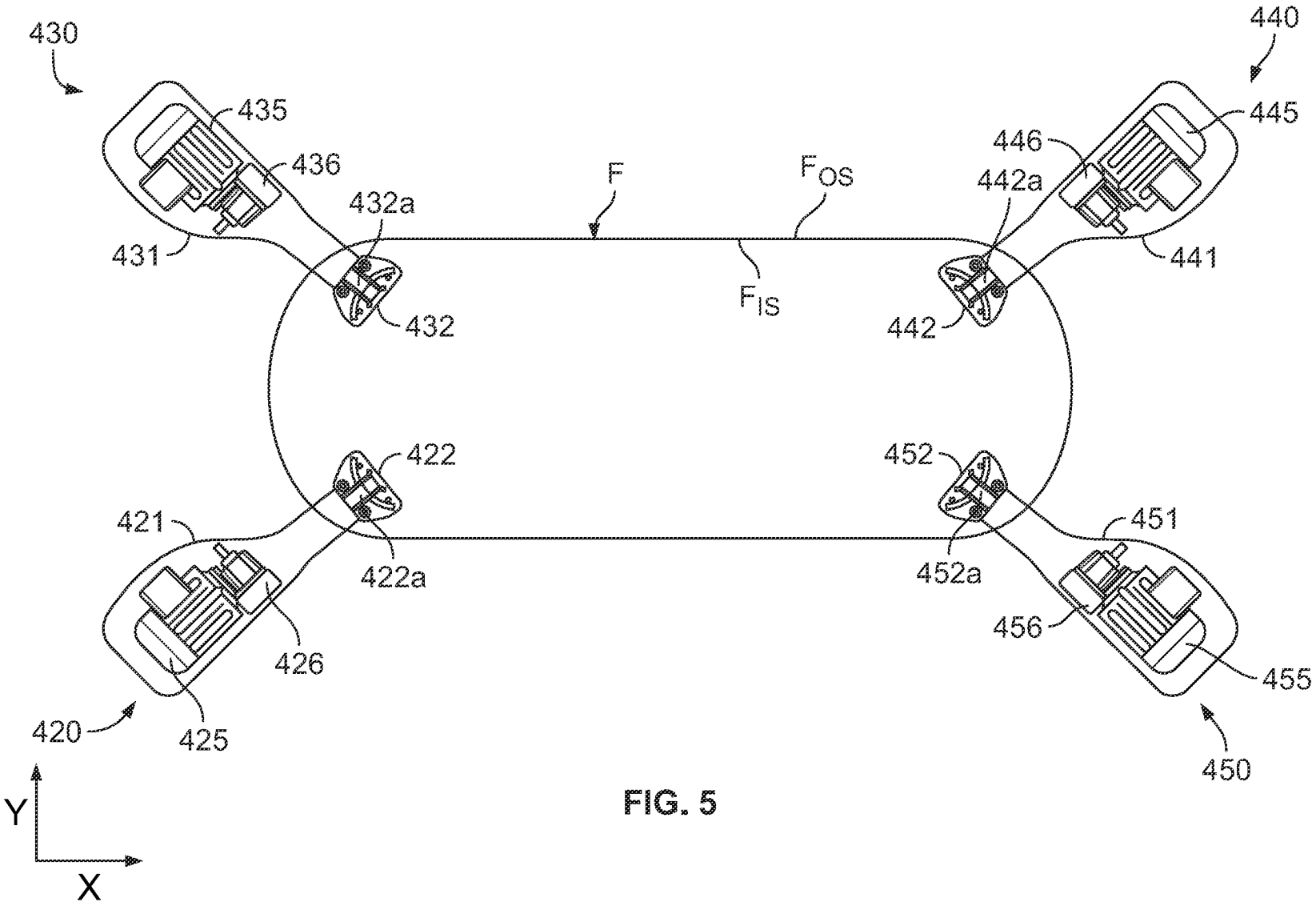
FIG. 5 is a simplified top plan view that corresponds to FIG. 4.

The reefing devices are then moved to their insertion positions, as block 1006 indicates. In this example embodiment, the controller 600 controls the first and second sets of reefing-device actuators 420*a* and 440*a* to move the respective reefing devices 420, 430, 440, and 450 laterally inwardly relative to the segment of tubular film F (in the X- and Y-directions and generally parallel to the X-Y plane) to their respective insertion positions in which they form an insertion configuration. FIGS. 4 and 5 show the reefing devices 420, 430, 440, and 450 at their insertion positions. The insertion positions are preset (such as by the operator) based on several factors, including the size of the film (e.g., its unstretched perimeter). At this point, and as shown in FIG. 3 for the reefing device 420, the first, second, third, and fourth carriages 424, 434, 444, and 454 of the first, second, third, and fourth reefing devices 420, 430, 440, and 450 are in their respective home positions. The wrapping carriage is then raised so the reefing fingers of the reefing devices are received in the open bottom portion of the segment of tubular film, as block 1008 indicates. In this example embodiment, the controller 600 controls the wrapping-carriage actuator 410 to raise the wrapping carriage so the reefing fingers 422, 432, 442, and 452 of the respective reefing devices 420, 430, 440, and 450 are received in the open bottom portion of the segment of tubular film F.

Figure 6:
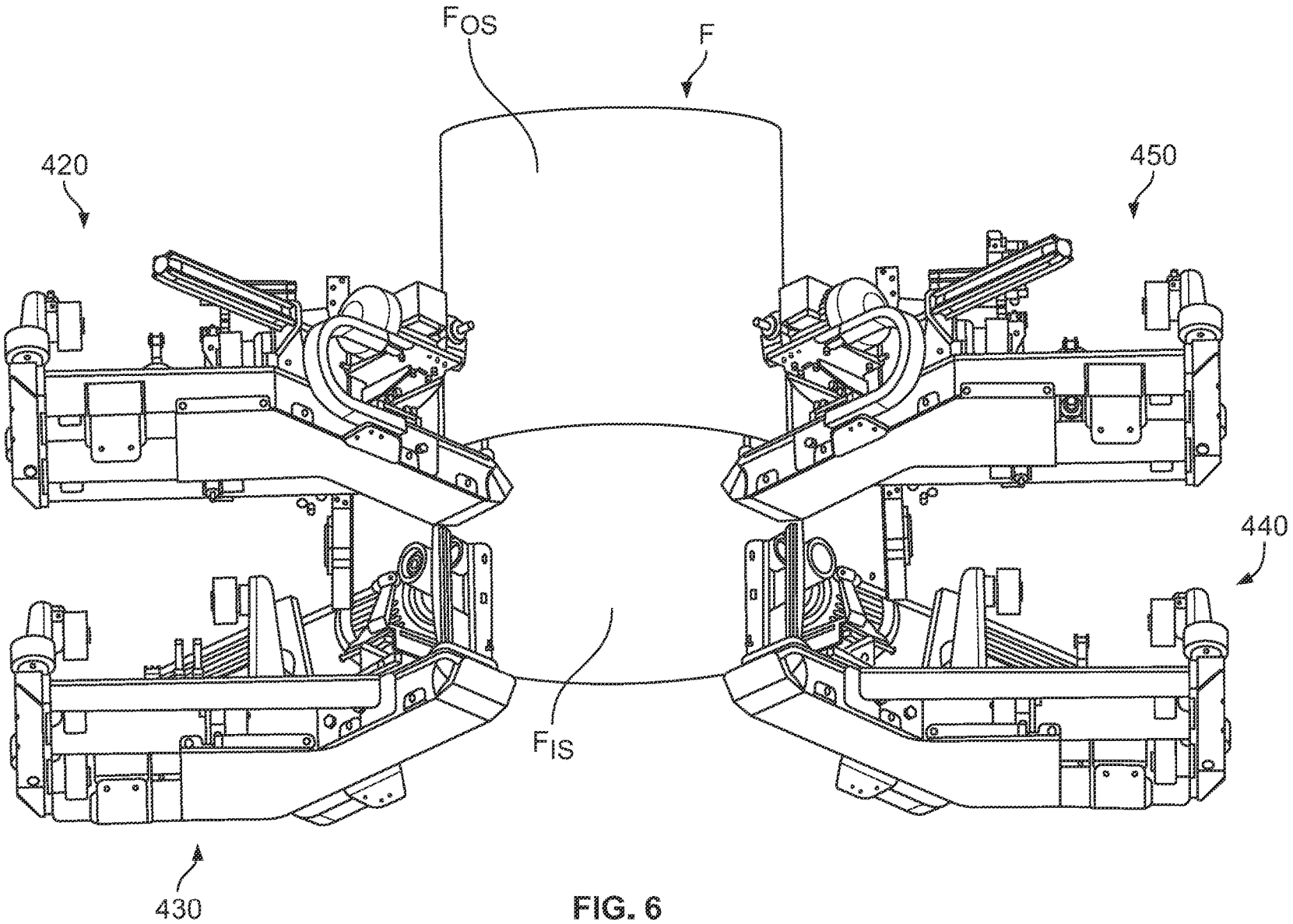
FIG. 6 is a perspective view similar to FIG. 4 but after the reefing fingers of the reefing devices have been inserted into the bottom of the segment of tubular film and after the reefing carriages of the reefing devices have moved to their respective reefing positions.
Figure 7:
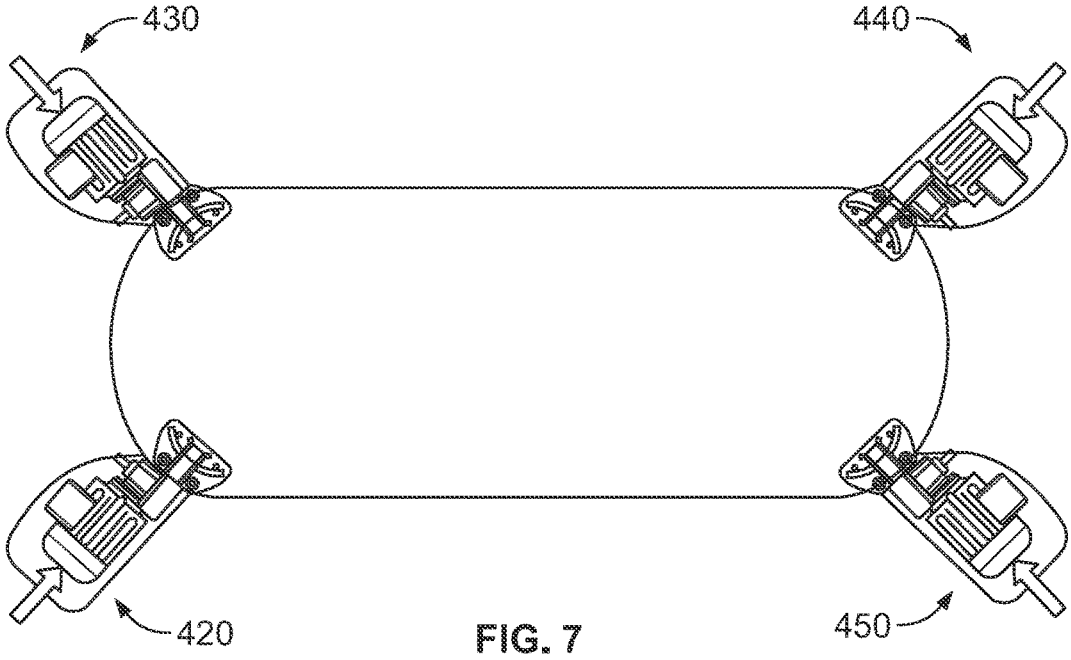
FIG. 7 is a simplified top plan view that corresponds to FIG. 6.
Figure 9:
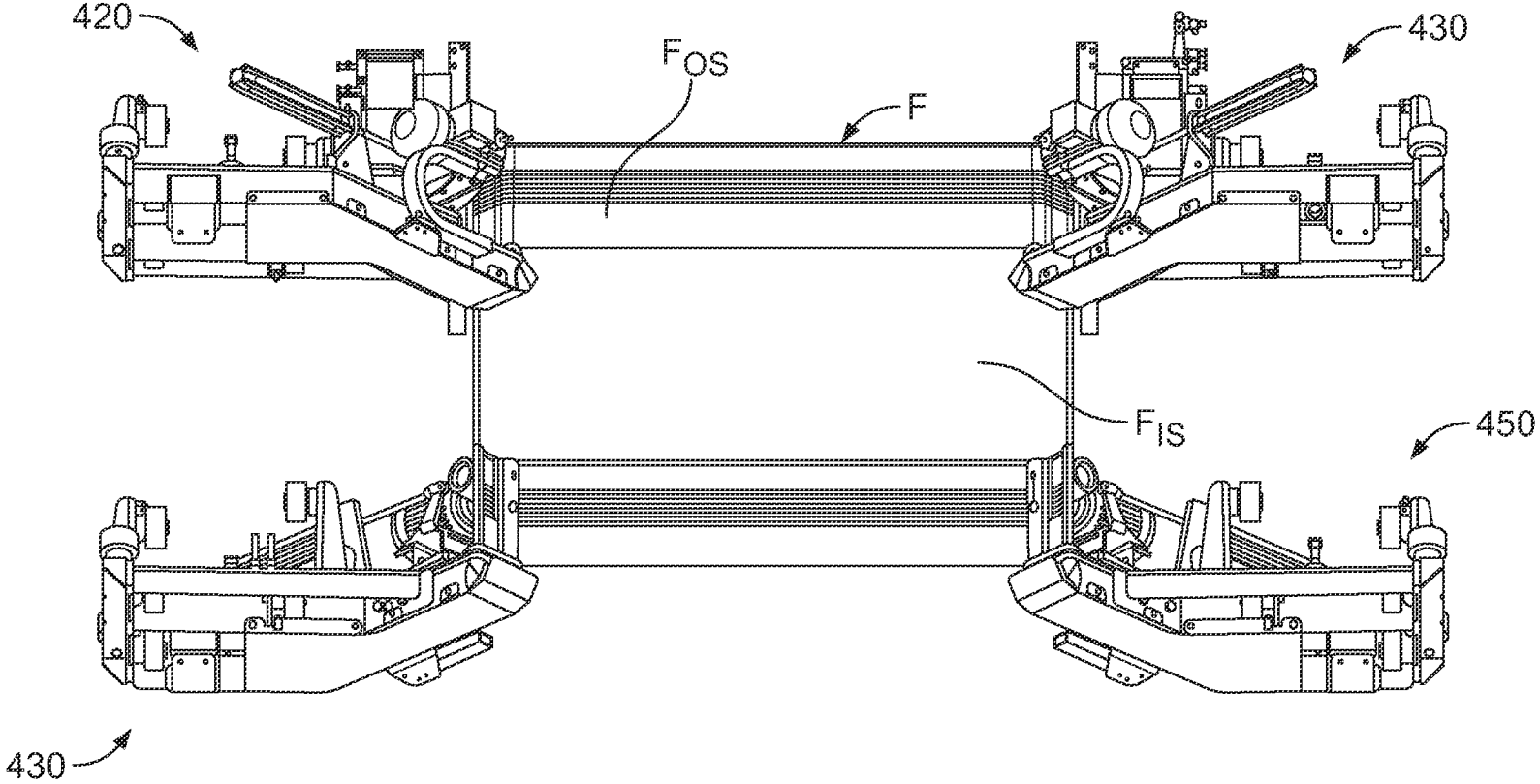
FIG. 9 is a perspective view similar to FIG. 4 but after the reefing devices have reefed the segment of tubular film onto their reefing fingers.

The reefing devices are then moved to their reefing positions, and the reefing devices reef the segment of tubular film onto the reefing fingers, as block 1010 indicates. In this example embodiment, the controller 600 controls the first and second sets of reefing-device actuators 420*a* and 440*a* to move the respective reefing devices 420, 430, 440, and 450 laterally outwardly relative to the segment of tubular film F (in the X- and Y-directions and generally parallel to the X-Y plane) to their respective reefing positions in which they form a reefing configuration in preparation for reefing the segment of tubular film F. The controller 600 then controls the first, second, third, and fourth carriage actuators 427, 437, 447, and 457 to move the respective carriages 424, 434, 444, and 454 from their respective home positions to their respective reefing positions, which causes the drive wheels 425, 435, 445, and 455 of the reefing devices 420, 430, 440, and 450 to contact the inner surface FIN of the segment of tubular film F and force the outer surface Four of the segment of tubular film F against the respective guide wheels 422*a*, 432*a*, 442*a*, and 452*a*. FIGS. 6-8 show the reefing devices 420, 430, 440, and 450 in their reefing positions after their carriages have moved to their respective reefing positions. In certain embodiments, the carriages move to their reefing positions as the reefing devices move to their reefing positions. The controller 600 then controls the first, second, third, and fourth roller actuators 426, 436, 446, and 456 to drive the first, second, third, and fourth drive rollers 425, 435, 445, and 455 in a reefing rotational direction to reef the segment of tubular film F onto the reefing fingers 422, 432, 442, and 452. FIGS. 9 and 10 show the reefing devices 420, 430, 440, and 450 after reefing.

The reefing devices then begin moving toward respective stretching positions and stretching the segment of tubular film, as block 1012 indicates. In this example embodiment, the controller 600 controls the first and second sets of reefing-device actuators 420*a* and 440*a* to begin moving the respective reefing devices 420, 430, 440, and 450 from their respective reefing positions to their respective stretching positions, causing the segment of tubular film to stretch. Here, the stretching positions of the respective reefing devices are located laterally outward (in the X- and Y-directions and generally parallel to the X-Y plane) relative to the reefing positions and are set so the segment of tubular film is stretched to about 60% when the reefing fingers reach their stretching positions (though the stretching positions and the segment of tubular film's resulting stretch percentage may differ in other embodiments). Additionally, in this example embodiment, the reefing devices each follow a 45-degree path within the X-Y plane as they move from their respective reefing positions to their respective stretching positions (though the movement path and resulting angle may differ in other embodiments).

As the reefing devices move to their stretching positions, a reefing-device-actuator parameter associated with the reefing-device actuators is monitored, as block 1014 indicates. In this example embodiment, the controller 600 monitors the electric current drawn by the first set of reefing-device actuators 420*a* (though in other embodiments the controller 600 monitors the electric current drawn by the second set of reefing-device actuators or both the first and second sets of reefing-device actuators). Specifically, as the first set of reefing-device actuators 420*a* moves the reefing devices 420 and 430 from their respective reefing positions to their respective stretching positions, the actuators periodically send signals identifying their electric current draw at those points in time to the controller 600, which stores data representing the electric current draw in memory. Other parameters associated with the reefing-device actuators may be monitored in other embodiments. For instances, in certain embodiments, the reefing devices includes pressure sensors configured to measure the force the reefing fingers impart on the film during stretching, and in these embodiments the controller monitors and stores data representing this stretching force. In certain embodiments, a designated period of time elapses after the reefing devices begin moving and before the reefing-device-actuator parameter is monitored.

The reefing devices stop moving once they reach their stretching positions, as block 1016 indicates. In this example embodiment, the controller 600 controls the first and second sets of reefing-device actuators 420*a* and 440*a* to stop moving the respective reefing devices 420, 430, 440, and 450 once they reach their respective stretching positions.

A measured stretching parameter is determined based on the reefing-device-actuator parameter, as block 1018 indicates. In this example embodiment, the measured stretching parameter represents the maximum force required to stretch the segment of tubular film F as the reefing devices move from their reefing positions to their stretching positions. Here, the controller 600 sets the maximum electric current drawn by the first set of reefing-device actuators 420*a* during stretching as the measured stretching parameter. In other embodiments, the controller 600 determines and stores a second measured stretching parameter in the form of the electric current drawn by the first set of reefing-device actuators 420 at the point in time at which the perimeter of the segment of tubular film F reaches a particular value.

In certain embodiments, the controller calculates a moving average of a certain quantity (such as ten) of electric current draw values or of all of the electric current draw values received from the first set of reefing device actuators within a certain time frame. In these embodiments, the controller sets the maximum moving average of the electric current draw values as the measured stretching parameter (rather than the highest singular electric current draw value received). In other embodiments, the controller converts the maximum electric current drawn by the first set of reefing device actuators (or the maximum moving average, depending on the embodiment) to a maximum force using a lookup table or a formula. The controller sets this force as the measured stretching parameter. In certain embodiments, the controller determines the measured stretching parameter based on both sets of reefing device actuators.

The reefing devices then begin moving back toward their respective reefing positions, as block 1020 indicates, thereby enabling the segment of tubular film to retract. In this example embodiment, the controller 600 controls the first and second sets of reefing-device actuators 420*a* and 440*a* to begin moving the respective reefing devices 420, 430, 440, and 450 from their respective stretching positions back to their respective reefing positions. In certain embodiments, the controller waits a designated period of time (such as three seconds) before starting to move the reefing devices back to their respective reefing positions. A countdown timer is started at this point in time, as block 1022 indicates. In this example embodiment, the controller 600 starts a two-minute countdown timer (though any suitable time period may be employed).

The controller determines whether a first disengagement condition is satisfied, as diamond 1024 indicates. In this example embodiment, the first disengagement condition is satisfied when the segment of tubular film F disengages three of the four reefing fingers 422, 432, 442, and 452 (though in other embodiments the disengagement condition is satisfied when the segment of tubular film F disengages one, two, or all four of the reefing fingers). Here, the controller 600 monitors feedback from the film sensors 420*s*, 430*s*, 440*s*, and 450*s* to determine when the segment of tubular film F disengages the reefing fingers. If the controller determines at diamond 1024 that the first disengagement condition is not satisfied, the controller determines whether the countdown timer has expired, as diamond 1026 indicates. If the controller determines at diamond 1026 that the countdown timer has not expired, the process 1000 returns to the diamond 1024.

If, on the other hand, the controller determines at diamond 1026 that the countdown timer has expired, the reefing devices stop moving, as block 1027 indicates. In this example embodiment, the controller 600 controls the first and second sets of reefing-device actuators 420*a* and 440*a* to stop moving the respective reefing devices 420, 430, 440, and 450. The controller determines both a first measured retraction parameter and a second measured retraction parameter, as block 1028 indicates. In this example embodiment, the controller 600 determines the perimeter of the segment of tubular film F (based on the relative positions of the reefing devices and as is known in the art) and sets this perimeter as both the first measured retraction parameter and the second measured retraction parameter. The process 1000 then proceeds to block 1044, described below.

Returning to diamond 1024, if the controller determines that the first disengagement condition is satisfied, the reefing devices stop moving, as block 1030 indicates. In this example embodiment, the controller 600 controls the first and second sets of reefing-device actuators 420*a* and 440*a* to stop moving the respective reefing devices 420, 430, 440, and 450. The controller determines a first measured retraction parameter, as block 1032 indicates. In this example embodiment, the controller 600 determines the perimeter of the segment of tubular film F (based on the relative positions of the reefing devices and as is known in the art) and sets this perimeter as the first measured retraction parameter.

The controller then independently monitors whether a continuation condition is satisfied, as diamond 1034 indicates, and whether the countdown timer has expired, as diamond 1036 indicates. In this example embodiment, the continuation condition is satisfied when the segment of tubular film F engages two of the four reefing fingers 422, 432, 442, and 452. Here, the controller 600 monitors feedback from the film sensors 420*s*, 430*s*, 440*s*, and 450*s* to determine when the segment of tubular film F engages the reefing fingers. If the controller determines that the continuation condition is satisfied at diamond 1034, the reefing devices continue to move toward their reefing positions, as block 1038 indicates. In this example embodiment, the controller 600 controls the first and second sets of reefing-device actuators 420*a* and 440*a* to continue moving the respective reefing devices 420, 430, 440, and 450 toward their respective reefing positions.

As the reefing devices are moving, the controller monitors for whether a second disengagement condition is satisfied, as diamond 1039 indicates (in addition to monitoring for whether the countdown timer has expired). In this example embodiment, the second disengagement condition is satisfied when the segment of tubular film F disengages three of the four reefing fingers 422, 432, 442, and 452 (though in other embodiments the second disengagement condition is satisfied when the segment of tubular film F disengages one, two, or all four of the reefing fingers). Thus, in this example embodiment, the second disengagement condition is the same as the first disengagement condition (though they may differ in other embodiments). Here, the controller 600 monitors feedback from the film sensors 420*s*, 430*s*, 440*s*, and 450*s* to determine when the segment of tubular film F disengages the reefing fingers. If the controller determines at diamond 1039 that the second disengagement condition is satisfied, the reefing devices stop moving, as block 1040 indicates. In this example embodiment, the controller 600 controls the first and second sets of reefing-device actuators 420*a* and 440*a* to stop moving the respective reefing devices 420, 430, 440, and 450. The process 1000 returns to diamond 1034, with the controller monitoring for satisfaction of the continuation condition (in addition to monitoring for whether the countdown timer has expired).

Once the controller determines at diamond 1036 that the countdown timer has expired, if the reefing devices are still moving they stop moving, as block 1041 indicates. In this example embodiment, the controller 600 controls the first and second sets of reefing-device actuators 420*a* and 440*a* to stop moving the respective reefing devices 420, 430, 440, and 450. The controller determines a second measured retraction parameter, as block 1042 indicates. In this example embodiment, the controller 600 determines the perimeter of the segment of tubular film F (based on the relative positions of the reefing devices and as is known in the art) and sets this perimeter as the second measured retraction parameter.

After the countdown timer has expired, the controller will have determined the measured stretching parameter, the first measured retraction parameter, and the second measured retraction parameter. The controller uses these measured performance parameters to compare the segment of tubular film F—and therefore the roll R of tubular film—to a baseline tubular film, as block 1044 indicates. In this example embodiment, the controller 600 stores (or is otherwise configured to access) a baseline stretching parameter, a baseline snap-back parameter, and a second measured retraction parameter for the particular type of film the roll is made of. The controller 600 compares and determines a difference (if any) between the measured stretching parameter and the baseline stretching parameter, the first measured retraction parameter and the baseline snap-back parameter, and the second measured retraction parameter and the baseline memory parameter. These differences, if any, and their magnitudes indicate how different the segment of tubular film F is from the baseline. In certain embodiments, the operator interface 500 displays the parameters and/or the differences.

In some embodiments, the controller 600 calculates a percent difference between each measured parameter and its respective baseline parameter. The controller determines whether the calculated percent differences are each below a maximum allowable percent difference. If so, the controller determines that the performance parameters of the film of the roll R are consistent with the baseline performance parameters of that type of film, and the operator interface 500 displays a corresponding indication. If not, the controller determines that the performance parameters of the film of the roll R are inconsistent with the baseline performance parameters of that type of film, and the operator interface 500 displays a corresponding indication.

In other embodiments, the first measured retraction parameter represents the time elapsed from the point in time the reefing fingers begin moving from their stretching positions back toward their reefing positions to the point in time at which the first disengagement condition is satisfied or, if the first disengagement is not satisfied before the countdown timer expires, it represents the time elapsed from the point in time the reefing fingers begin moving from their stretching positions back toward their reefing positions to the point in time at which the countdown timer expires. In these embodiments, the first baseline retraction parameter to which the first measured retraction parameter is compared also represents an elapsed time period.

Figure 12A:
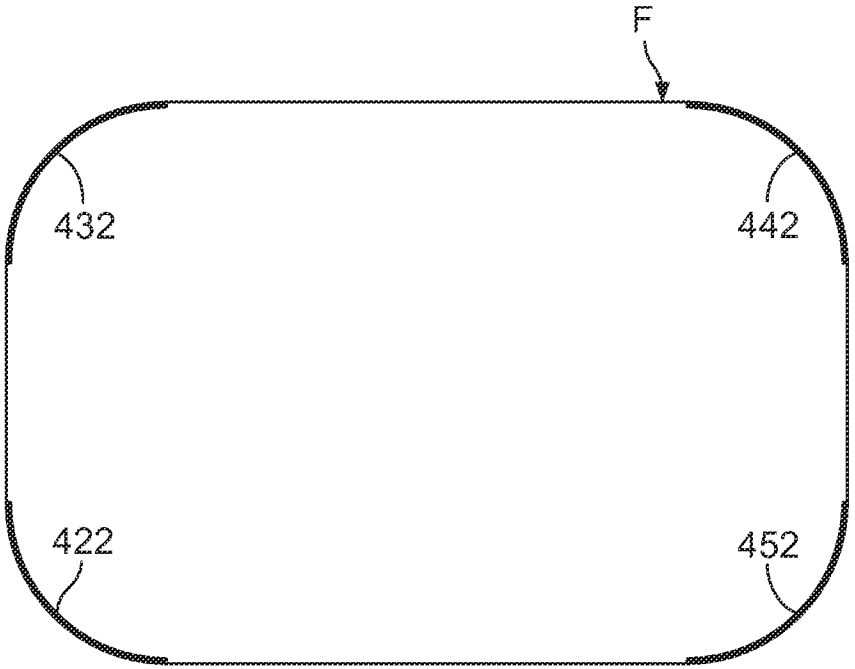
FIGS. 12A-12G are diagrammatic top plan views showing the reefing fingers of the reefing devices and the perimeter of the segment of tubular film during the film-evaluation process of FIGS. 11A and 11B.
Figure 12B:
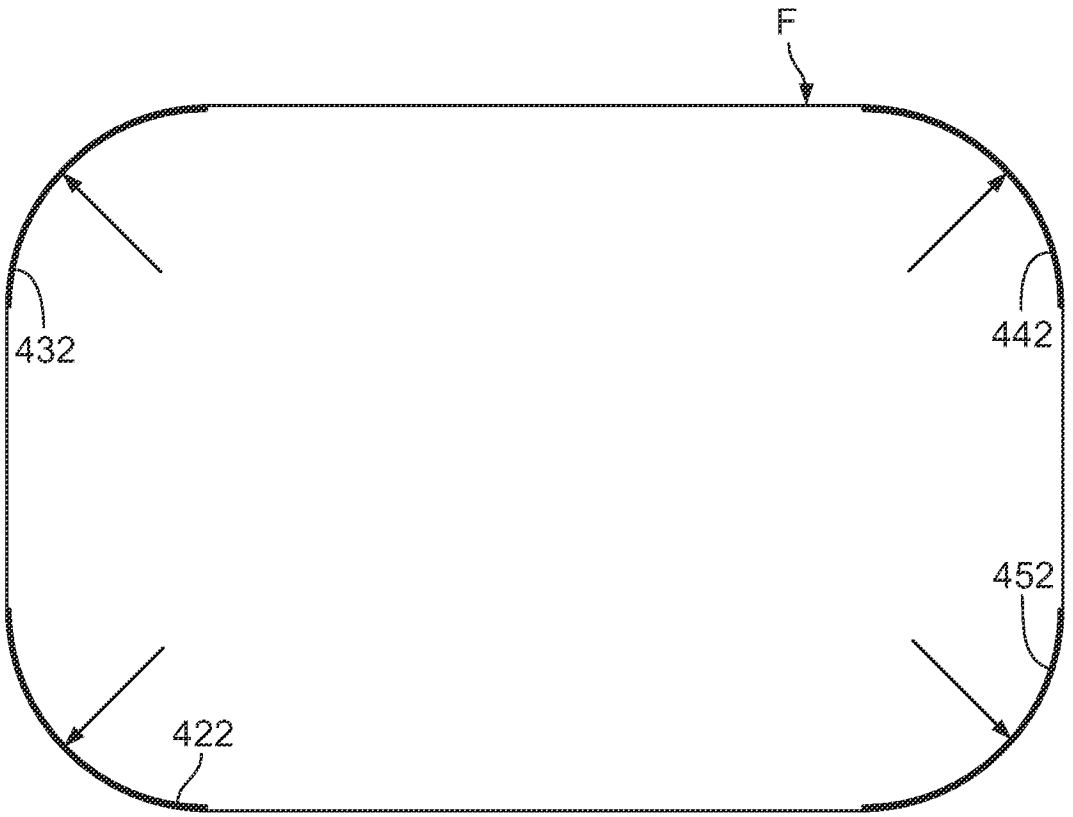
Figure 12C:
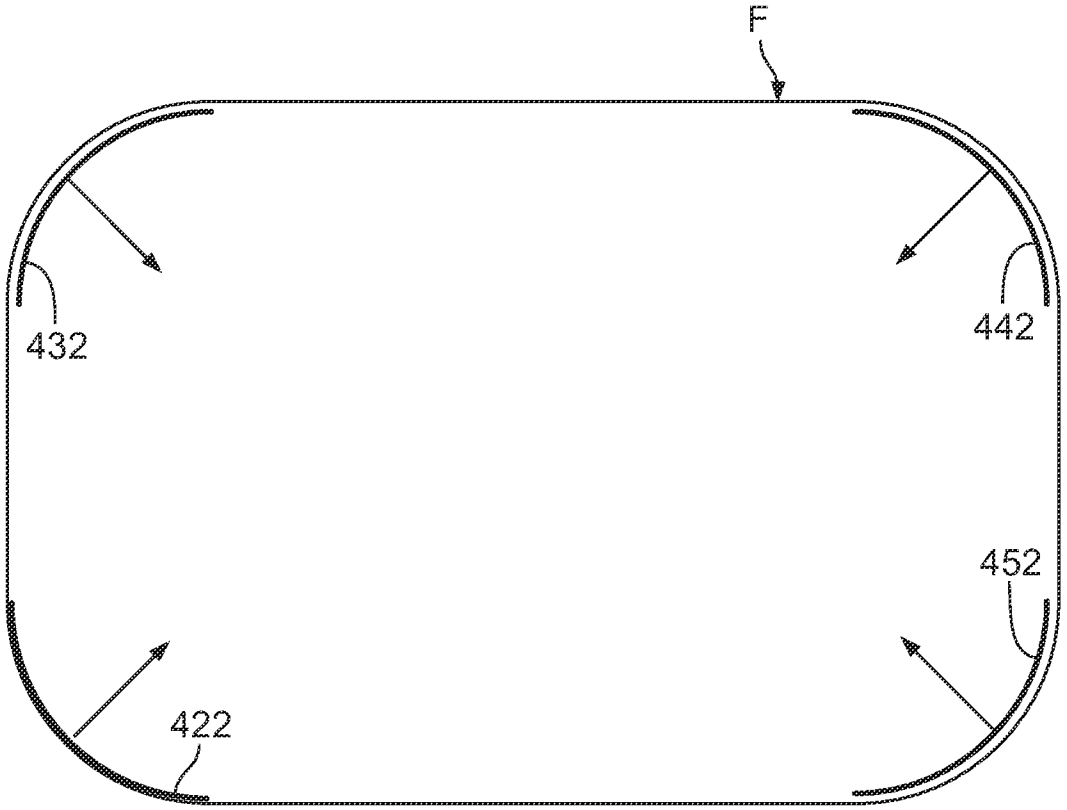
Figure 12D:
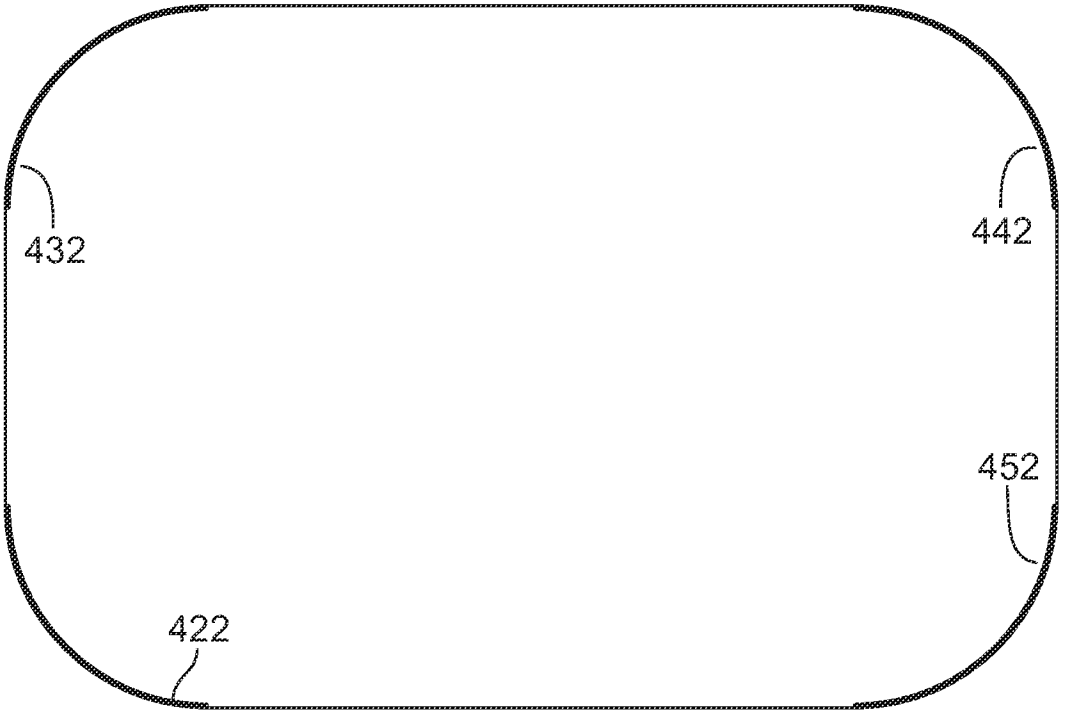
Figure 12E:
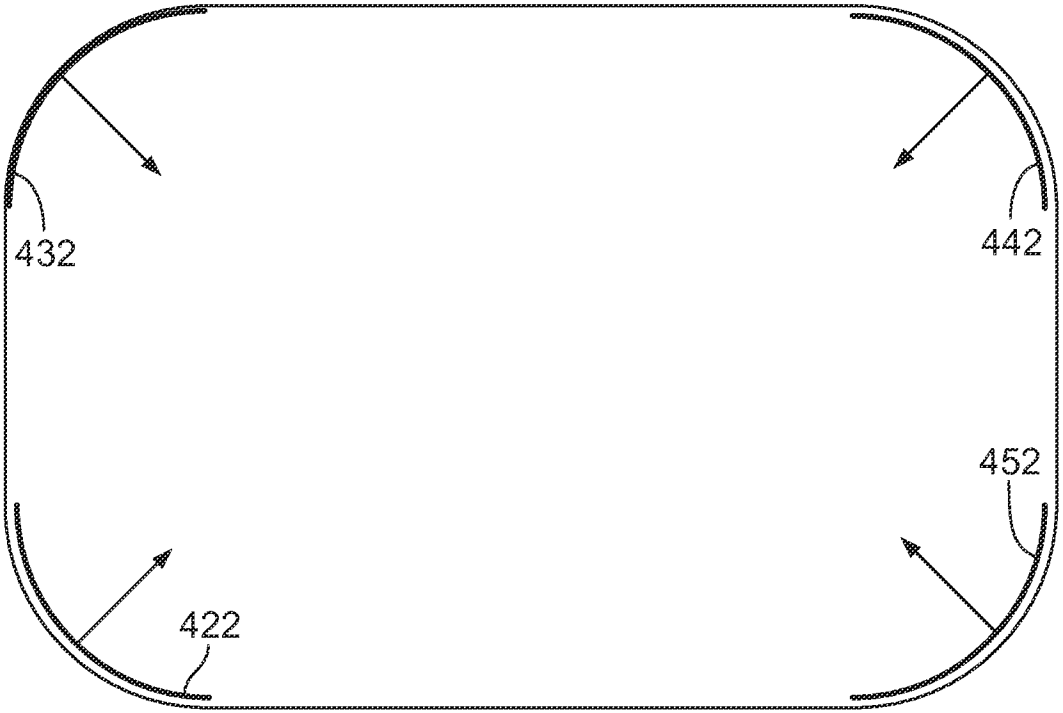
Figure 12F:
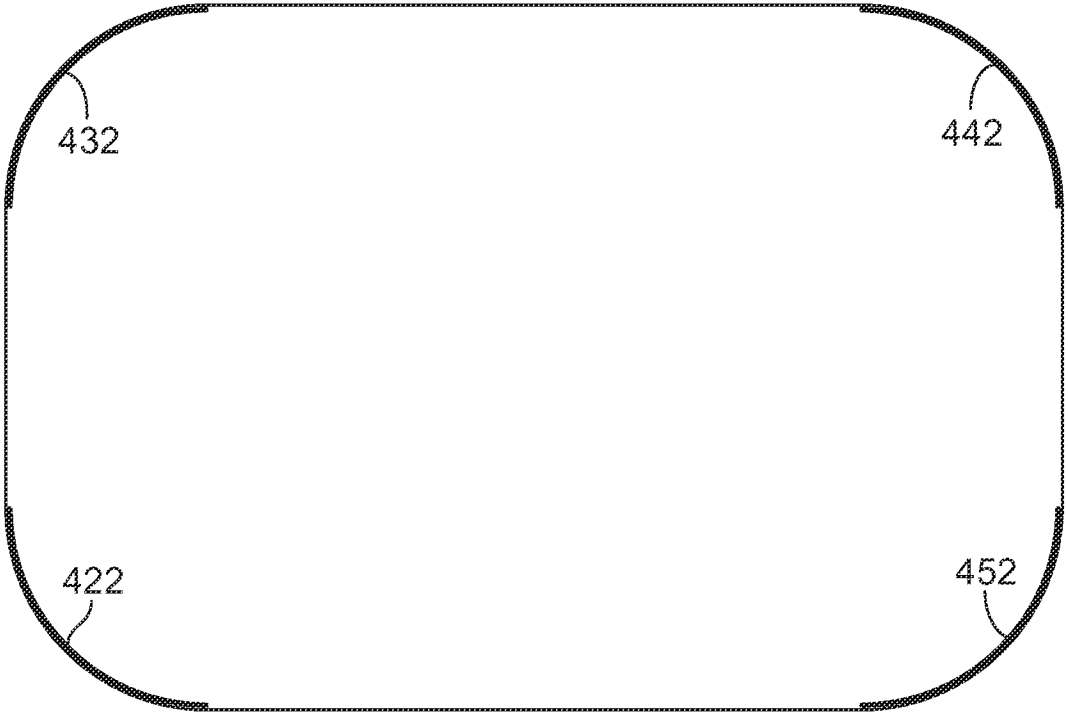
Figure 12G:
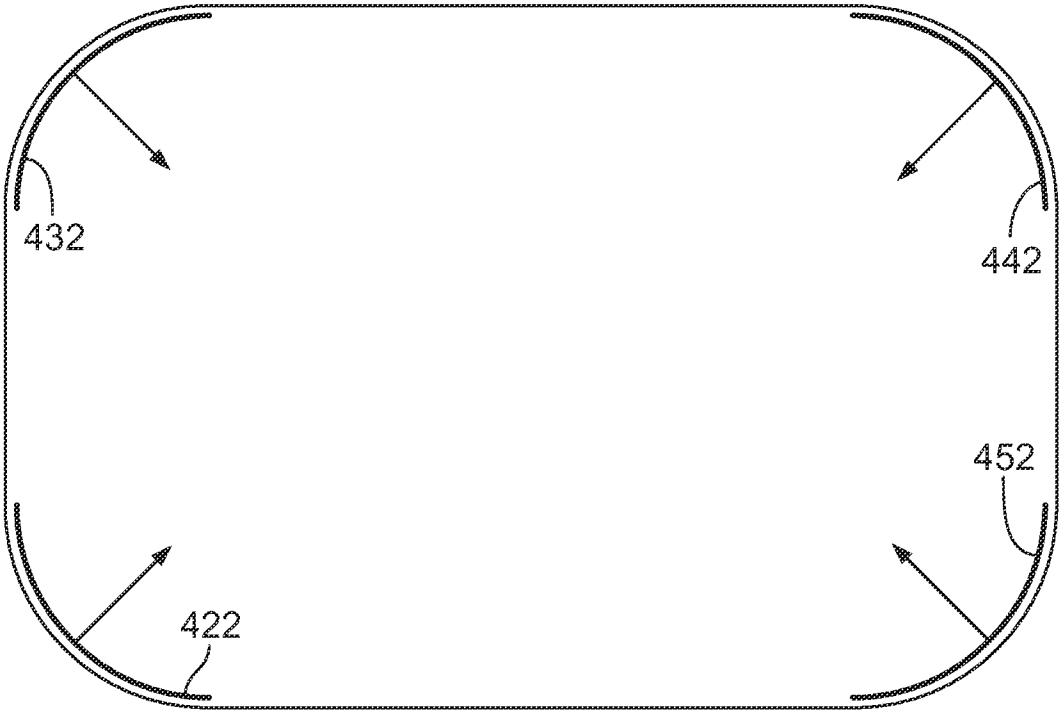

FIGS. 12A-12G show reefing fingers 422, 432, 442, and 452 along with the perimeter of the segment of tubular film F during certain stages of the film-evaluation process 1000. Specifically, FIG. 12A shows the reefing fingers and the perimeter of the segment of tubular film F after reefing. FIG. 12B shows the reefing fingers in their stretching positions and the perimeter of the segment of tubular film F after stretching. FIG. 12C shows the reefing fingers and the perimeter of the segment of tubular film F after the segment of tubular film F has disengaged the reefing fingers 432, 442, and 452, thus satisfying the first disengagement condition. FIG. 12D shows the reefing fingers and the perimeter of the segment of tubular film F after the segment of tubular film F has re-engaged the reefing fingers 432, 442, and 452, thus satisfying the continuation condition. FIG. 12E shows the reefing fingers and the perimeter of the segment of tubular film F after the segment of tubular film F has disengaged the reefing fingers 422, 442, and 452, thus satisfying the second disengagement condition. FIG. 12F shows the reefing fingers and the perimeter of the segment of tubular film F after the segment of tubular film F has re-engaged the reefing fingers 422, 442, and 452, thus satisfying the continuation condition. FIG. 12G shows the reefing fingers and the perimeter of the segment of tubular film F after the segment of tubular film F has disengaged the reefing fingers 422, 432, 442, and 452, thus (again) satisfying the second disengagement condition. After this point in time the countdown timer expires.

Figure 13A:
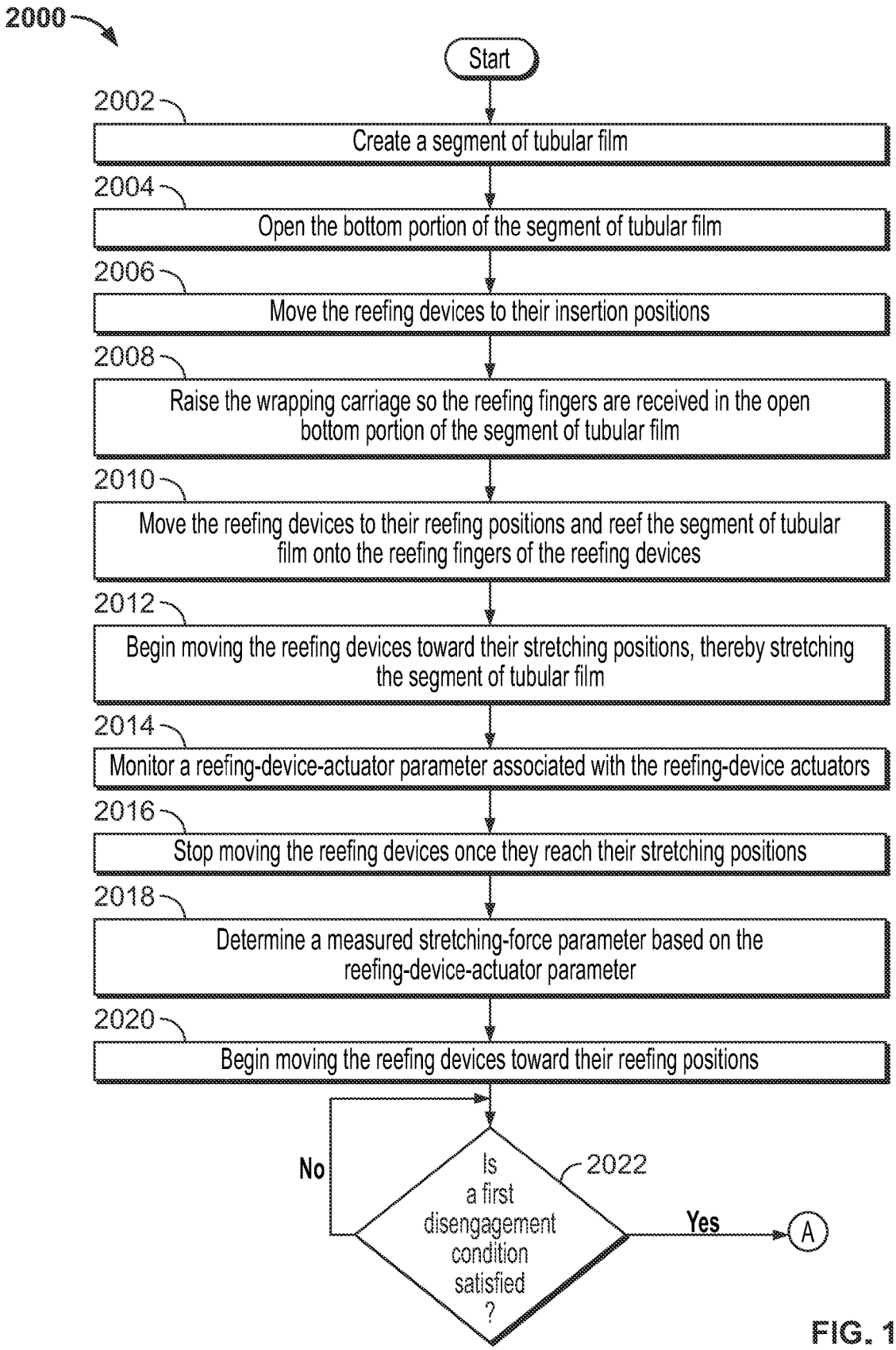
FIGS. 13A and 13B are a flowchart of another example film-evaluation process of the present disclosure.
Figure 13B:
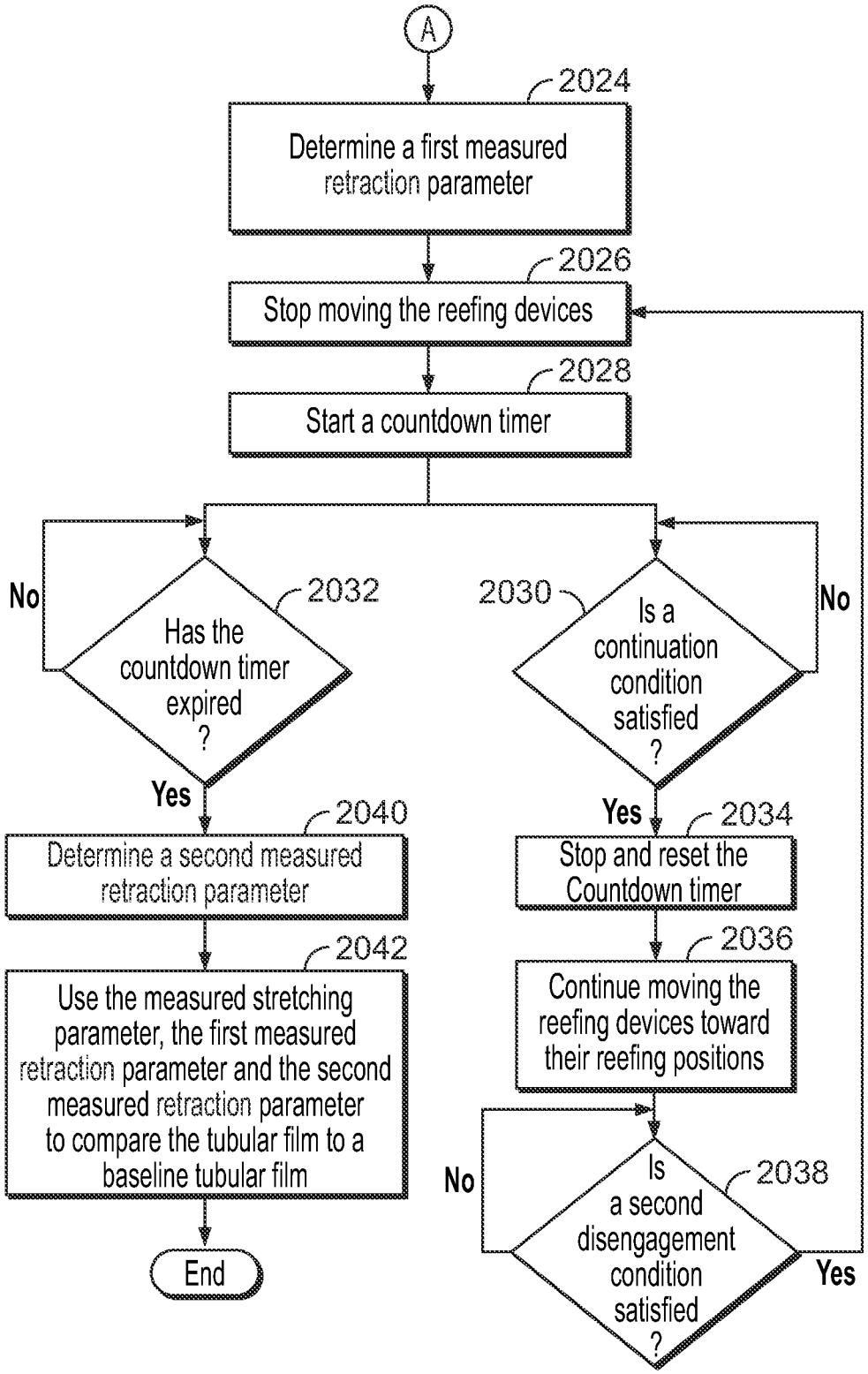

FIGS. 13A and 13B are a flowchart of another example film-evaluation process 2000 of the present disclosure, which will be described below with reference to FIGS. 3-10. In this example embodiment, like in the film-evaluation process 1000, the controller 600 determines a measured stretching parameter, a first measured retraction parameter, a second measured retraction parameter. In certain embodiments, the controller is configured to determine the baseline performance parameters by carrying out a process similar to the film-evaluation process 2000, storing the measured parameters as baseline parameters, and not performing the comparing step. In various such embodiments, the baseline parameters are determined using the same machine used to determine the measured parameters (to avoid machine-to-machine variance).

Turning now to the film-evaluation process 2000, upon initiation of the process, a segment of tubular film is created, as block 2002 indicates. In this example embodiment, the controller 600 controls the film-supply assembly 200 to draw tubular film from the film roll R and cut the film to an evaluation length (which is 200 centimeters in this example embodiment but may be any other suitable length) to form the segment of tubular film F. The bottom portion of the segment of tubular film is then opened, as block 2004 indicates. In this example embodiment, the controller 600 controls the film-opening assembly 300 (and more particularly, the suction boxes and holding devices) to open the bottom portion of the segment of tubular film F so the shape of its perimeter is generally rectangular, as explained above.

The reefing devices are then moved to their insertion positions, as block 2006 indicates. In this example embodiment, the controller 600 controls the first and second sets of reefing-device actuators 420*a* and 440*a* to move the respective reefing devices 420, 430, 440, and 450 laterally inwardly relative to the segment of tubular film F (in the X- and Y-directions and generally parallel to the X-Y plane) to their respective insertion positions in which they form an insertion configuration. FIGS. 4 and 5 show the reefing devices 420, 430, 440, and 450 at their insertion positions.

The insertion positions are preset (such as by the operator) based on several factors, including the size of the film (e.g., its unstretched perimeter). At this point, and as shown in FIG. 3 for the reefing device 420, the first, second, third, and fourth carriages 424, 434, 444, and 454 of the first, second, third, and fourth reefing devices 420, 430, 440, and 450 are in their respective home positions. The wrapping carriage is then raised so the reefing fingers of the reefing devices are received in the open bottom portion of the segment of tubular film, as block 2008 indicates. In this example embodiment, the controller 600 controls the wrapping-carriage actuator 410 to raise the wrapping carriage so the reefing fingers 422, 432, 442, and 452 of the respective reefing devices 420, 430, 440, and 450 are received in the open bottom portion of the segment of tubular film F.

The reefing devices are then moved to their reefing positions, and the reefing devices reef the segment of tubular film onto the reefing fingers, as block 2010 indicates. In this example embodiment, the controller 600 controls the first and second sets of reefing-device actuators 420*a* and 440*a* to move the respective reefing devices 420, 430, 440, and 450 laterally outwardly relative to the segment of tubular film F (in the X- and Y-directions and generally parallel to the X-Y plane) to their respective reefing positions in which they form a reefing configuration in preparation for reefing the segment of tubular film F. The controller 600 then controls the first, second, third, and fourth carriage actuators 427, 437, 447, and 457 to move the respective carriages 424, 434, 444, and 454 from their respective home positions to their respective reefing positions, which causes the drive wheels 425, 435, 445, and 455 of the reefing devices 420, 430, 440, and 450 to contact the inner surface FIN of the segment of tubular film F and force the outer surface Four of the segment of tubular film F against the respective guide wheels 422*a*, 432*a*, 442*a*, and 452*a*. FIGS. 6-8 show the reefing devices 420, 430, 440, and 450 in their reefing positions after their carriages have moved to their respective reefing positions. In certain embodiments, the carriages move to their reefing positions as the reefing devices move to their reefing positions. The controller 600 then controls the first, second, third, and fourth roller actuators 426, 436, 446, and 456 to drive the first, second, third, and fourth drive rollers 425, 435, 445, and 455 in a reefing rotational direction to reef the segment of tubular film F onto the reefing fingers 422, 432, 442, and 452. FIGS. 9 and 10 show the reefing devices 420, 430, 440, and 450 after reefing.

The reefing devices then begin moving toward respective stretching positions and stretching the segment of tubular film, as block 2012 indicates. In this example embodiment, the controller 600 controls the first and second sets of reefing-device actuators 420*a* and 440*a* to begin moving the respective reefing devices 420, 430, 440, and 450 from their respective reefing positions to their respective stretching positions, causing the segment of tubular film to stretch. Here, the stretching positions of the respective reefing devices are located laterally outward (in the X- and Y-directions and generally parallel to the X-Y plane) relative to the reefing positions and are set so the segment of tubular film is stretched to about 60% when the reefing fingers reach their stretching positions (though the stretching positions and the segment of tubular film's resulting stretch percentage may differ in other embodiments). Additionally, in this example embodiment, the reefing devices each follow a 45-degree path within the X-Y plane as they move from their respective reefing positions to their respective stretching positions (though the movement path and resulting angle may differ in other embodiments).

As the reefing devices move to their stretching positions, a reefing-device-actuator parameter associated with the reefing-device actuators is monitored, as block 2014 indicates. In this example embodiment, the controller 600 monitors the electric current drawn by the first set of reefing-device actuators 420*a* (though in other embodiments the controller 600 monitors the electric current drawn by the second set of reefing-device actuators or both the first and second sets of reefing-device actuators). Specifically, as the first set of reefing-device actuators 420*a* moves the reefing devices 420 and 430 from their respective reefing positions to their respective stretching positions, the actuators periodically send signals identifying their electric current draw at those points in time to the controller 600, which stores data representing the electric current draw in memory. Other parameters associated with the reefing-device actuators may be monitored in other embodiments. For instances, in certain embodiments, the reefing devices includes pressure sensors configured to measure the force the reefing fingers impart on the film during stretching, and in these embodiments the controller monitors and stores data representing this stretching force.

The reefing devices stop moving once they reach their stretching positions, as block 2016 indicates. In this example embodiment, the controller 600 controls the first and second sets of reefing-device actuators 420*a* and 440*a* to stop moving the respective reefing devices 420, 430, 440, and 450 once they reach their respective stretching positions.

A measured stretching parameter is determined based on the reefing-device-actuator parameter, as block 2018 indicates. In this example embodiment, the measured stretching parameter represents the maximum force required to stretch the segment of tubular film F as the reefing devices move from their reefing positions to their stretching positions. Here, the controller 600 sets the maximum electric current drawn by the first set of reefing-device actuators 420*a* during stretching as the measured stretching parameter. In other embodiments, the controller 600 determines and stores a second measured stretching parameter in the form of the electric current drawn by the first set of reefing-device actuators 420 at the point in time at which the perimeter of the segment of tubular film F reaches a particular value.

In certain embodiments, the controller calculates a moving average of a certain quantity (such as ten) of electric current draw values or of all of the electric current draw values received from the first set of reefing device actuators within a certain time frame. In these embodiments, the controller sets the maximum moving average of the electric current draw values as the measured stretching parameter (rather than the highest singular electric current draw value received). In other embodiments, the controller converts the maximum electric current drawn by the first set of reefing device actuators (or the maximum moving average, depending on the embodiment) to a maximum force using a lookup table or a formula. The controller sets this force as the measured stretching parameter. In certain embodiments, the controller determines the measured stretching parameter based on both sets of reefing device actuators.

The reefing devices then begin moving back toward their respective reefing positions, as block 2020 indicates. In this example embodiment, the controller 600 controls the first and second sets of reefing-device actuators 420*a* and 440*a* to begin moving the respective reefing devices 420, 430, 440, and 450 from their respective stretching positions back to their respective reefing positions. In certain embodiments, the controller waits a designated period of time (such as three seconds) before starting to move the reefing devices back to their respective reefing positions. As the reefing devices are moving, the controller monitors for whether a first disengagement condition is satisfied, as diamond 2022 indicates. In this example embodiment, the first disengagement condition is satisfied when the segment of tubular film F disengages three of the four reefing fingers 422, 432, 442, and 452. Here, the controller 600 monitors feedback from the film sensors 420*s*, 430*s*, 440*s*, and 450*s* to determine when the segment of tubular film F disengages the reefing fingers.

If the controller determines at diamond 2022 that the first disengagement condition is satisfied, the controller determines a first measured retraction parameter, as block 2024 indicates, and the reefing devices stop moving, as block 2026 indicates. In this example embodiment, the controller 600 determines the perimeter of the segment of tubular film F (based on the relative positions of the reefing devices and as is known in the art) at the point in time the first disengagement condition is satisfied and sets this perimeter as the first measured retraction parameter. In this example embodiment, the controller 600 controls the first and second sets of reefing-device actuators 420*a* and 440*a* to stop moving the respective reefing devices 420, 430, 440, and 450.

A countdown timer is started, as block 2028 indicates. In this example embodiment, the controller 600 starts a thirty-second countdown timer (though any suitable time period may be employed). The controller then independently monitors whether a continuation condition is satisfied, as diamond 2030 indicates, and whether the countdown timer has expired, as diamond 2032 indicates. In this example embodiment, the continuation condition is satisfied when the segment of tubular film F engages two of the four reefing fingers 422, 432, 442, and 452. Here, the controller 600 monitors feedback from the film sensors 420*s*, 430*s*, 440*s*, and 450*s* to determine when the segment of tubular film F engages the reefing fingers. If the controller determines that the continuation condition is satisfied at diamond 2030, the countdown timer is stopped and reset, as block 2034 indicates, and the reefing devices continue to move toward their reefing positions, as block 2036 indicates. In this example embodiment, the controller 600 resets the countdown timer to thirty seconds and controls the first and second sets of reefing-device actuators 420*a* and 440*a* to continue moving the respective reefing devices 420, 430, 440, and 450 toward their respective reefing positions.

As the reefing devices are moving, the controller monitors for whether a second disengagement condition is satisfied, as diamond 2038 indicates (in addition to monitoring for whether the countdown timer has expired). In this example embodiment, the second disengagement condition is satisfied when the segment of tubular film F disengages three of the four reefing fingers 422, 432, 442, and 452. Thus, in this example embodiment, the second disengagement condition is the same as the first disengagement condition (though they may differ in other embodiments). Here, the controller 600 monitors feedback from the film sensors 420*s*, 430*s*, 440*s*, and 450*s* to determine when the segment of tubular film F disengages the reefing fingers. If the controller determines at diamond 2038 that the second disengagement condition is satisfied, the film-evaluation process returns to block 2026.

Once the controller determines at diamond 2032 that the countdown timer has expired, the controller determines a second measured retraction parameter, as block 2040 indicates. In this example embodiment, the controller 600 determines the perimeter of the segment of tubular film F (based on the relative positions of the reefing devices and as is known in the art) and sets this perimeter as the second measured retraction parameter.

After the countdown timer has expired, the controller will have determined the measured stretching parameter, the first measured retraction parameter, and the second measured retraction parameter. The controller uses these measured performance parameters to compare the segment of tubular film F—and therefore the roll R of tubular film—to a baseline tubular film, as block 2042 indicates and as generally described above.

In other embodiments, the first measured retraction parameter represents the time elapsed from the point in time the reefing fingers begin moving from their stretching positions back toward their reefing positions to the point in time at which the first disengagement condition is satisfied or, if the first disengagement is not satisfied before the countdown timer expires, it represents the time elapsed from the point in time the reefing fingers begin moving from their stretching positions back toward their reefing positions to the point in time at which the countdown timer expires. In these embodiments, the first baseline retraction parameter to which the first measured retraction parameter is compared also represents an elapsed time period.

The stretch-hood machine and film-evaluation processes of the present disclosure solve the above problems by enabling operators to evaluate whether a roll of tubular film will perform as expected before wrapping any loads with film from the roll. By confirming that a roll of film is consistent with the baseline film, the operator can reduce the likelihood that the film will not adequately wrap and support loads and, therefore, reduce the likelihood that the load will be damaged during transit.

Although the stretch-hood machine determines and evaluates three measured performance parameters while carrying out the above-described film-evaluation processes, in other embodiments the stretch-hood machine determines and evaluates only one or any other suitable quantity of measured performance parameters while carrying out the above-described film-evaluation processes. For instance, in certain embodiments, the stretch-hood machine determines and evaluates only one of or only two of: the measured stretching parameters, the first measured retraction parameter, and the second measured retraction parameter during the film-evaluation processes.

The invention claimed is:

1. A method of operating a stretch-hood machine to evaluate a segment of tubular film, the method comprising:

with a plurality of reefing devices in respective reefing positions, each reefing device comprising a reefing finger, reefing the segment of tubular film onto the reefing fingers;

moving the reefing devices laterally outwardly from their respective reefing positions to respective stretching positions, thereby causing the segment of tubular film to stretch;

moving the reefing devices laterally inwardly from their respective stretching positions toward their respective reefing positions, thereby enabling the segment of tubular film to retract;

determining, via a controller, a measured performance parameter of the segment of tubular film based on feedback associated with the movement of the reefing devices;

comparing, via the controller, the measured performance parameter of the segment of tubular film with a baseline performance parameter; and outputting an indication based on the comparison between the measured performance parameter and the baseline performance parameter.

2. The method of claim 1, wherein moving the reefing devices laterally outwardly and laterally inwardly comprises controlling one or more reefing-device actuators to move the reefing devices laterally outwardly and laterally inwardly, wherein the measured performance parameter comprises a measured stretching parameter, wherein the feedback comprises a reefing-device-actuator parameter associated with the one or more reefing device actuators, and wherein determining the measured performance parameter of the segment of tubular film based on the feedback received during the movement of the reefing devices comprises determining the measured stretching parameter based on the reefing-device-actuator parameter.

3. The method of claim 2, further comprising monitoring electric current drawn by the one or more reefing device actuators during the movement of the reefing devices laterally outwardly.

4. The method of claim 3, further comprising determining the measured stretching parameter based on the electric current drawn by the one or more reefing device actuators during the movement of the reefing devices laterally outwardly.

5. The method of claim 4, further comprising determining a maximum electric current drawn by the one or more reefing device actuators during the movement of the reefing devices laterally outwardly and setting the maximum electric current drawn as the measured stretching parameter.

6. The method of claim 4, further comprising determining a moving average of the electric current drawn by the one or more reefing device actuators during the movement of the reefing devices laterally outwardly.

7. The method of claim 6, further comprising determining a maximum moving average of the electric current drawn by the one or more reefing device actuators during movement of the reefing devices laterally outwardly and setting the maximum moving average as the measured stretching parameter.

8. The method of claim 1 wherein determining the measured performance parameter of the segment of tubular film based on the feedback received during the movement of the reefing devices comprises:

determining that a first disengagement condition has been satisfied based on the feedback received during the movement of the reefing devices laterally inward; and responsive to determining that the first disengagement condition has been satisfied, determining the measured performance parameter.

9. The method of claim 8, wherein determining the measured performance parameter comprises determining a perimeter of the segment of tubular film and setting the perimeter as the measured performance parameter.

10. The method of claim 8, wherein the plurality of reefing devices comprises four reefing devices, wherein the first disengagement condition is satisfied when the segment of tubular film has disengaged a designated quantity of the reefing fingers as the reefing devices move laterally inwardly, wherein the designated quantity is at least one.

11. The method of claim 10, further comprising monitoring, via one or more sensors, whether the segment of tubular film engages each of the reefing fingers of the reefing devices, wherein the feedback received during the movement of the reefing devices laterally inward comprises feedback from the sensors.

12. The method of claim 8, wherein the measured performance parameter comprises a first measured retraction parameter, the method further comprising, after the first disengagement condition has been satisfied:

determining that a second disengagement condition has been satisfied based on the feedback received during the movement of the reefing devices laterally inward;

responsive to determining that the second disengagement condition has been satisfied, determining a second measured retraction parameter of the segment of tubular film;

comparing the second measured retraction parameter with a second baseline performance parameter; and outputting an indication based on the comparison between the second measured retraction parameter and the second baseline performance parameter.

13. The method of claim 12, wherein the first and second disengagement conditions are different.

14. The method of claim 1, wherein the measured performance parameter comprises a first measured retraction parameter and the baseline performance parameter comprises a first baseline performance parameter, the method further comprising:

starting a countdown timer;

determining that the countdown timer has expired before a first disengagement condition has been satisfied based on the feedback received during the movement of the reefing devices laterally inward; and responsive to determining that the countdown timer has expired before the first disengagement condition has been satisfied:

determining the first measured retraction parameter and a second measured retraction parameter of the segment of tubular film;

comparing the second measured retraction parameter with a second baseline performance parameter; and outputting an indication based on the comparison between the second measured retraction parameter and the second baseline performance parameter.

15. The method of claim 1, wherein the measured performance parameter comprises a first measured retraction parameter and the baseline performance parameter comprises a first baseline performance parameter, the method further comprising:

determining that a first disengagement condition has been satisfied based on the feedback received during the movement of the reefing devices laterally inward; and responsive to determining that the first disengagement condition has been satisfied:

starting a countdown timer;

determining that the countdown timer has expired; and responsive to determining that the countdown timer has expired:

determining a second measured retraction parameter of the segment of tubular film;

comparing the second measured retraction parameter with a second baseline performance parameter; and outputting an indication based on the comparison between the second measured retraction parameter and the second baseline performance parameter.

16. The method of claim 1, wherein the measured performance parameter comprises a first measured retraction parameter and the baseline performance parameter comprises a first baseline performance parameter, the method further comprising:

starting a countdown timer;

determining that a first disengagement condition has been satisfied based on the feedback received during the movement of the reefing devices laterally inward before expiration of the countdown timer;

responsive to determining that the first disengagement condition has been satisfied before expiration of the countdown timer, determining the first measured retraction parameter;

determining that the countdown timer has expired after the first disengagement condition has been satisfied; and responsive to determining that the countdown timer has expired after the first disengagement condition has been satisfied:

determining the second measured retraction parameter;

comparing the second measured retraction parameter with a second baseline performance parameter; and outputting an indication based on the comparison between the second measured retraction parameter and the second baseline performance parameter.

17. A method of operating a stretch-hood machine to evaluate a segment of tubular film, the method comprising:

with a plurality of reefing devices in respective reefing positions, each reefing device comprising a reefing finger, reefing the segment of tubular film onto the reefing fingers;

moving the reefing devices laterally outwardly from their respective reefing positions to respective stretching positions, thereby causing the segment of tubular film to stretch;

moving the reefing devices laterally inwardly from their respective stretching positions toward their respective reefing positions, thereby enabling the segment of tubular film to retract;

determining a measured stretching parameter of the segment of tubular film based on feedback received during the movement of the reefing devices laterally outwardly;

determining a measured retraction parameter of the segment of tubular film based on feedback received during the movement of the reefing devices laterally inwardly;

comparing the measured stretching parameter of the segment of tubular film with a baseline stretching parameter;

comparing the measured retraction parameter of the segment of tubular film with a baseline retraction parameter; and outputting an indication based on the comparisons between the measured stretching parameter and the baseline stretching parameter and the measured retraction parameter and the baseline retraction parameter.

* * * * *